US008596749B2

(12) United States Patent
Tamaki et al.

(10) Patent No.: US 8,596,749 B2
(45) Date of Patent: Dec. 3, 2013

(54) LIQUID EJECTION APPARATUS AND METHOD FOR REPLACING HUMIDIFICATION-LIQUID TANK OF THE APPARATUS

(75) Inventors: Shuichi Tamaki, Nagoya (JP); Akira Shinoda, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/360,388

(22) Filed: Jan. 27, 2012

(65) Prior Publication Data

US 2012/0194604 A1 Aug. 2, 2012

(30) Foreign Application Priority Data

Jan. 31, 2011 (JP) ..... 2011-018956

(51) Int. Cl.
*B41J 2/165* (2006.01)

(52) U.S. Cl.
USPC ..... 347/22; 347/23; 347/29

(58) Field of Classification Search
USPC ..... 347/22–36
See application file for complete search history.

(56) References Cited

U.S. PATENT DOCUMENTS

| | | | | |
|---|---|---|---|---|
| 5,788,388 | A | 8/1998 | Cowger et al. | |
| 5,812,168 | A | 9/1998 | Pawlowski, Jr. et al. | |
| 2005/0168517 | A1 | 8/2005 | Usuda | |
| 2009/0109257 | A1* | 4/2009 | Shimazaki | 347/31 |
| 2009/0322818 | A1* | 12/2009 | Iwasaki | 347/14 |

FOREIGN PATENT DOCUMENTS

| | | | |
|---|---|---|---|
| JP | S63-303749 | A | 12/1988 |
| JP | H01-005852 | A | 1/1989 |
| JP | H03-184852 | A | 8/1991 |
| JP | H10-029324 | A | 2/1998 |
| JP | H10-202901 | A | 8/1998 |
| JP | 2002-127440 | A | 5/2002 |
| JP | 2003-334962 | A | 11/2003 |
| JP | 2004-122543 | A | 4/2004 |
| JP | 2004-335313 | A | 11/2004 |

OTHER PUBLICATIONS

European Patent Office, extended European Search Report for European Patent Application No. 12152923.4, dated May 25, 2012.
Japan Patent Office, Notification of Reason for Refusal for Japanese Patent Application No. 2011-018956, mailed Mar. 5, 2013.

* cited by examiner

*Primary Examiner* — Jannelle M Lebron
(74) *Attorney, Agent, or Firm* — Baker Botts L.L.P.

(57) ABSTRACT

A liquid ejection apparatus including: a head having a face that has ejection openings through which liquid is ejected to record an image on a recording medium, an ejection space being defined so as to face the face; a humidification-liquid tank storing humidification liquid having a nonvolatile component; a sealing mechanism configured to selectively establish a sealing state in which the sealing mechanism seals the ejection space from an outside and an unsealing state in which the sealing mechanism does not seal the ejection space from the outside; and a humid-air supply mechanism configured to supply humid air into the ejection space when the sealing mechanism is in the sealing state, the humid air being an air humidified by the humidification liquid in the humidification-liquid tank, wherein the humidification-liquid tank is configured to be mountable on and removable from the humid-air supply mechanism.

17 Claims, 10 Drawing Sheets

LIQUID EJECTION APPARATUS AND METHOD FOR REPLACING HUMIDIFICATION-LIQUID TANK OF THE APPARATUS

CROSS REFERENCE TO RELATED APPLICATION

The present application claims priority from Japanese Patent Application No. 2011-018956, which was filed on Jan. 31, 2011, the disclosure of which is herein incorporated by reference in its entirety.

BACKGROUND OF THE INVENTION

1. Field of the Invention

The present invention relates to (i) a liquid ejection apparatus configured to humidify ejection openings through which liquid droplets are ejected, in order to prevent an increase in a viscosity of liquid in the ejection openings and (ii) a method for replacing a humidification-liquid tank of the liquid ejection apparatus.

2. Description of the Related Art

There is conventionally known a technique for preventing an increase in a viscosity of ink in nozzles formed in a nozzle face (ejection face) of a head in a liquid ejection apparatus. In this technique, an inside of a cap for airtightly capping or sealing the nozzle face and a water tank (humidification-liquid tank) storing water (humidification liquid) therein are communicated with each other. As a result, air humidified by the water stored in the water tank is supplied into the cap.

SUMMARY OF THE INVENTION

In the above-described technique, where the water to be replenished into the water tank contains nonvolatile components such as a preserving agent, a concentration of the nonvolatile components in the water tank increases by a repetition of evaporation of the water in the water tank and the replenishment of the water. When the concentration of the nonvolatile components in the water tank increases, a proportion of water components decreases. Thus, a humidification performance of the liquid ejection apparatus decreases, making it impossible to efficiently produce a humidified air.

This invention has been developed in view of the above-described situations, and it is an object of the present invention to provide a liquid ejection apparatus capable of preventing a humidification performance thereof from decreasing and a method for replacing a humidification-liquid tank of the liquid ejection apparatus.

The object indicated above may be achieved according to the present invention which provides a liquid ejection apparatus comprising: a liquid ejection head having an ejection face that has a plurality of ejection openings formed therein, the liquid ejection head being configured to eject liquid through the plurality of ejection openings to record an image on a recording medium, an ejection space being defined so as to face the ejection face; a humidification-liquid tank storing humidification liquid that has a nonvolatile component; a sealing mechanism configured to selectively establish (i) a sealing state in which the sealing mechanism seals the ejection space from an outside and (ii) an unsealing state in which the sealing mechanism does not seal the ejection space from the outside; and a humid-air supply mechanism configured to supply humid air into the ejection space when the sealing mechanism is in the sealing state, the humid air being an air humidified by the humidification liquid in the humidification-liquid tank, wherein the humidification-liquid tank is configured to be mountable on and removable from the humid-air supply mechanism.

The object indicated above may also be achieved according to the present invention which provides a method for replacing a humidification-liquid tank of a liquid ejection apparatus, the liquid ejection apparatus comprising: a liquid ejection head having an ejection face that has a plurality of ejection openings formed therein, the liquid ejection head being configured to eject liquid through the plurality of ejection openings to record an image on a recording medium, an ejection space being defined so as to face the ejection face; the humidification-liquid tank storing humidification liquid that has a nonvolatile component; a sealing mechanism configured to selectively establish (i) a sealing state in which the sealing mechanism seals the ejection space from an outside and (ii) an unsealing state in which the sealing mechanism does not seal the ejection space from the outside; a humid-air supply mechanism configured to supply humid air into the ejection space when the sealing mechanism is in the sealing state, the humid air being an air humidified by the humidification liquid in the humidification-liquid tank, the humidification-liquid tank being configured to be mountable on and removable from the humid-air supply mechanism; and a display configured to display a screen for prompting a replacement of the humidification-liquid tank, the method comprising replacing the humidification-liquid tank after the display has displayed the screen for prompting the replacement of the humidification-liquid tank.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which:

FIGS. 6A and 6B are partial cross-sectional views of FIG. 5, wherein FIG. 6A is a partial cross-sectional view showing an area VI enclosed with a one-dot chain line in FIG. 5, and FIG. 6B is a partial cross-sectional view showing an area V enclosed with a two-dot chain line in FIG. 5;

FIGS. 7A and 7B are views for explaining mounting of the humidification-liquid tank on the air circulation mechanism, wherein FIG. 7A shows a state thereof before the mounting, and FIG. 7B shows a state thereof after the mounting;

FIGS. 10A and 10B are partial cross-sectional views for explaining a modification of the humidification-liquid tank, wherein FIG. 10A is a partial cross-sectional view showing a humidification-liquid tank in a first modification, FIG. 10B is a partial cross-sectional view showing a humidification-liquid tank in a second modification after mounting thereof.

DETAILED DESCRIPTION OF THE EMBODIMENTS

First Embodiment

Figure 1:
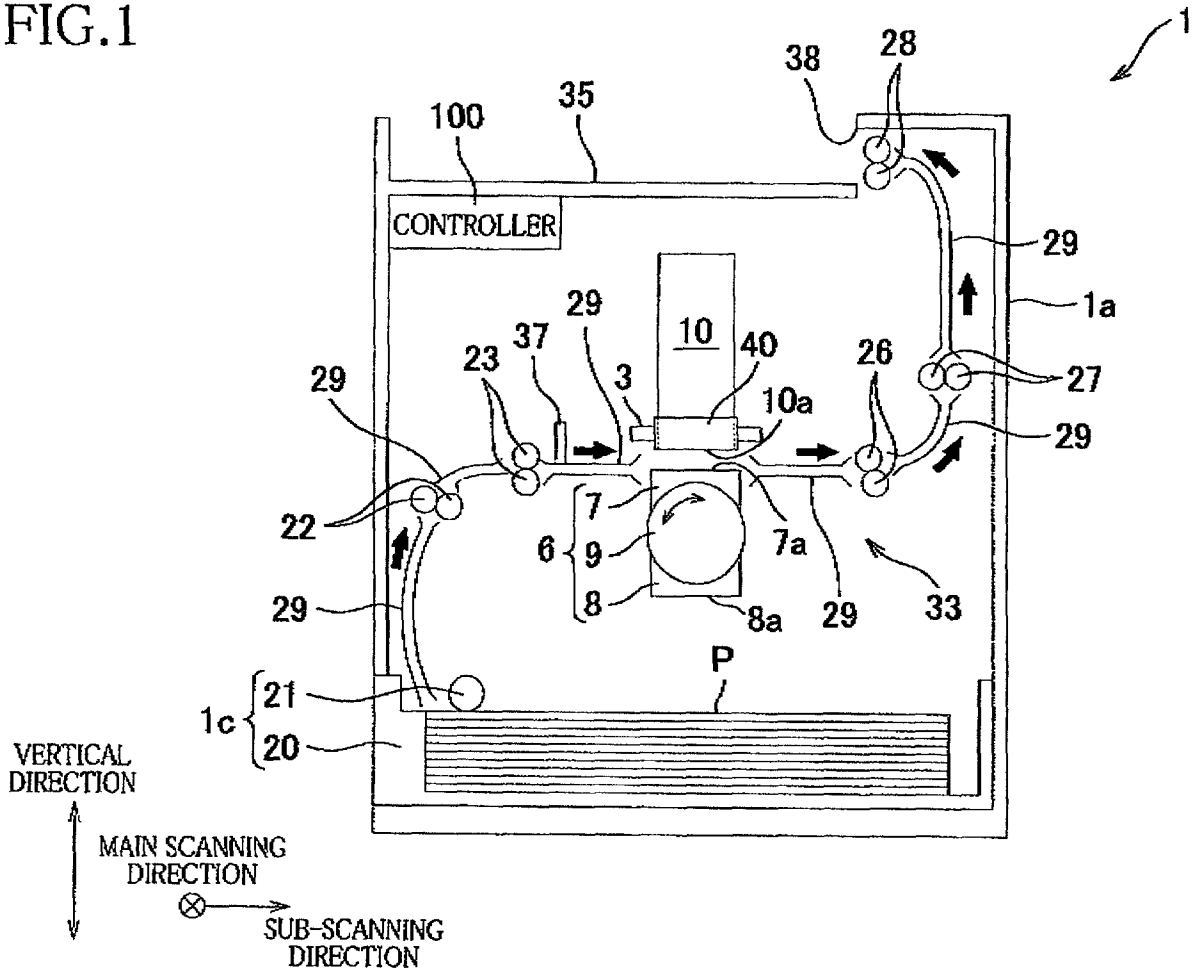
FIG. 1 is a side view generally showing an internal structure of an ink-jet printer as a first embodiment of the present invention.

Hereinafter, there will be described embodiments of an ink-jet printer as a liquid ejection apparatus to which the present invention is applied, by reference to the drawings.

First, there will be explained an overall construction of an ink-jet printer 1 as a first embodiment of the present invention with reference to FIG. 1.

The printer 1 includes a casing 1*a* having a rectangular parallelepiped shape. A sheet-discharge portion 35 is provided on a top plate of the casing 1*a*. In a space defined by the casing 1*a*, there is formed a sheet conveyance path through which a sheet P (as one example of a recording medium) is conveyed from a sheet-supply unit 1*c* which will be described below toward the sheet-discharge portion 35 along bold arrows in FIG. 1.

The casing 1*a* accommodates (a) a head 10, (b) a conveyance unit 33 configured to convey the sheet P through a position facing or just under an ejection face 10*a* of the head 10, (c) a support-cap unit 6 corresponding to the head 10, (d) an air circulation mechanism 50 and a humidification-liquid tank 60 (see FIG. 5) used for a humidifying maintenance, (e) a cartridge, not shown, storing black ink to be supplied to the head 10, (f) a display 90 (see FIG. 8) for displaying information for a user, (g) a controller 100 for controlling operations of components of the printer 1, and so on.

The head 10 is a line head having a generally rectangular parallelepiped shape elongated in a main scanning direction. A lower face of the head 10 is the ejection face 10*a* having a multiplicity of ejection openings 14*a* (see FIGS. 3 and 4) opened therein. In image recording (image forming), the head 10 ejects the black ink from the ejection openings 14*a*. The head 10 is supported by the casing 1*a* via a head holder 3. The head holder 3 supports the head 10 such that the ejection face 10*a* faces a support face 7*a* which will be described below with a specific space therebetween appropriate for the image recording. On the head holder 3 is provided a circular cap 40 (as one example of a sealing mechanism) for covering an outer region of the ejection face 10*a* of the head 10. Specific constructions of the head 10 and the head holder 3 will be explained later.

On the basis of image data transmitted from an external device, the controller 100 controls: a conveyance operation of the components of the printer 1 for conveying the sheet P; an ink ejecting operation synchronized with the conveyance of the sheet P; a maintenance operation for recovering or maintaining an ejection characteristic; and so on.

The maintenance operation includes flushing, purging, wiping, the humidifying maintenance, and so on. The flushing is an operation for forcibly ejecting the ink from ejection opening(s) 14*a* by driving actuators of the head 10 on the basis of flushing data that is different from the image data, and this flushing is performed for a part or all of the ejection openings 14*a*. The purging is an operation for forcibly ejecting the ink from all of the ejection openings 14*a* by applying a pressure to the ink in the head 10 by, e.g., a pump. The wiping is an operation for wiping foreign matters (e.g., the ink) on the ejection face 10*a* by a wiper after the flushing or the purging. The humidifying maintenance is an operation for supplying humid air into ejection space S1 (see FIG. 5) opposed to the ejection face 10*a*. The purging and the flushing are performed where the ink is not ejected from the ejection openings 14*a* for a predetermined length of time (noted that this predetermined length of time may be set to be longer in the purging than in the flushing). In the purging and the flushing, the ink whose viscosity has increased in the ejection openings 14*a*, and air bubbles and dust particles in the ejection openings 14*a* are discharged with the ink from the ejection openings 14*a*.

The conveyance unit 33 includes the sheet-supply unit 1*c*, a guide 29, conveyance-roller pairs 22, 26-28, and a register-roller pair 23 and constitutes the sheet conveyance path extending from the sheet-supply unit 1*c* to the sheet-discharge portion 35. The sheet-supply unit 1*c*, the conveyance-roller pairs 22, 26-28, and the register-roller pair 23 are controlled by the controller 100.

The sheet-supply unit 1*c* includes a sheet-supply tray (accommodating portion) 20 and a sheet-supply roller 21. The sheet-supply tray 20 can be mounted on and removed from the casing 1*a* in a sub-scanning direction. The sheet-supply tray 20 has a box-like shape opening upward and can accommodate sheets P. The sheet-supply roller 21 is rotated by control of the controller 100 to supply an uppermost one of the sheets P in the sheet-supply tray 20. Here, the sub-scanning direction is a direction parallel to a conveyance direction in which the sheet P is conveyed by the conveyance unit 33, and the main scanning direction is a direction parallel to a horizontal plane and perpendicular to the sub-scanning direction.

The sheet P supplied by the sheet-supply roller 21 is conveyed to the register-roller pair 23 while being guided by the guide 29 and nipped by the conveyance-roller pair 22. The register-roller pair 23 nips a leading end of the sheet P conveyed by the conveyance-roller pair 22 for a set registering time in a state in which the register-roller pair 23 is not rotated. As a result, an inclination (oblique conveyance) of the sheet P is corrected in the state in which the leading end of the sheet P is nipped by the register-roller pair 23. After the registering time has passed, the register-roller pair 23 is rotated to convey the sheet P whose inclination has been corrected, to the position between the head 10 and the support-cap unit 6.

When the sheet P has been conveyed to the position between the head 10 and the support-cap unit 6 by the register-roller pair 23 and passes through the position just under the head 10 in the sub-scanning direction, the ink is ejected from the ejection openings 14*a*, whereby a monochrome image is formed on the sheet P. The ink ejecting operation from the ejection openings 14*a* is controlled by the controller 100 on the basis of a detection signal transmitted from a sheet sensor 37. The sheet P is then conveyed upward by the conveyance-roller pairs 26, 27, 28 while being guided by the guide 29. The sheet P is finally discharged onto the sheet-discharge portion 35 through an opening 38 formed in an upper portion of the casing 1*a*.

Figure 2:
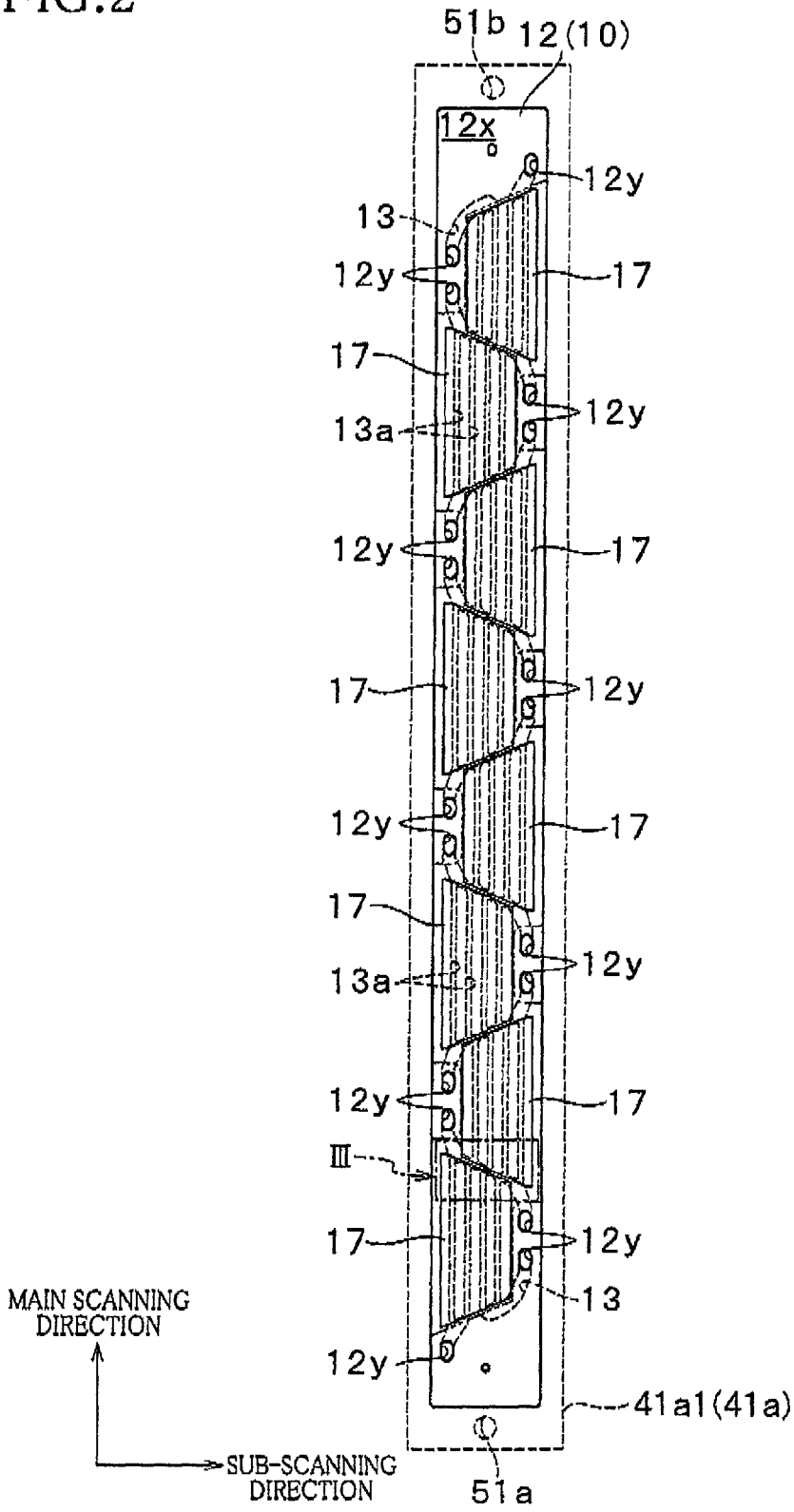
FIG. 2 is a plan view showing a channel unit and actuator units of each ink-jet head of the printer in FIG. 1.
Figure 3:
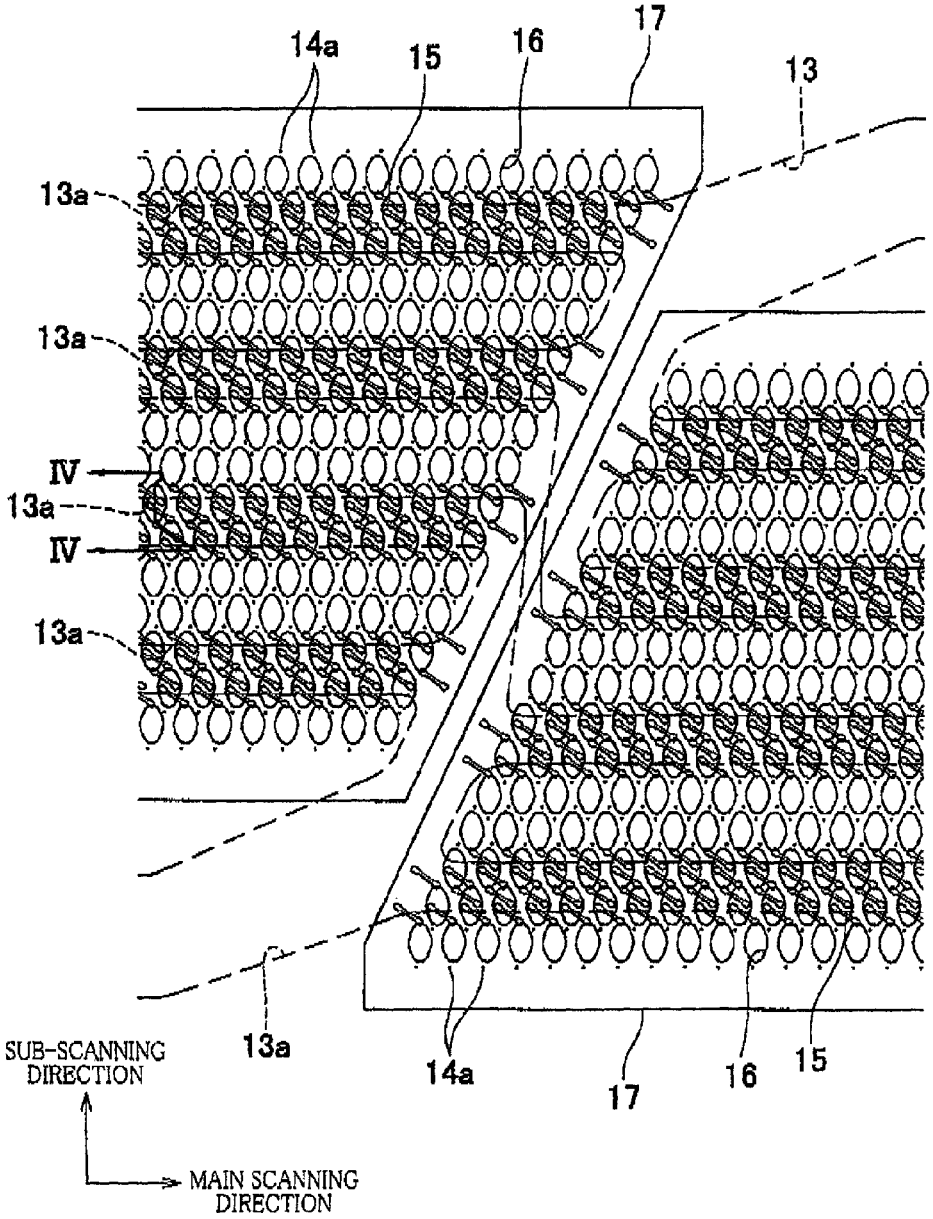
FIG. 3 is an enlarged view showing an area III enclosed by one-dot chain line in FIG. 2.
Figure 4:
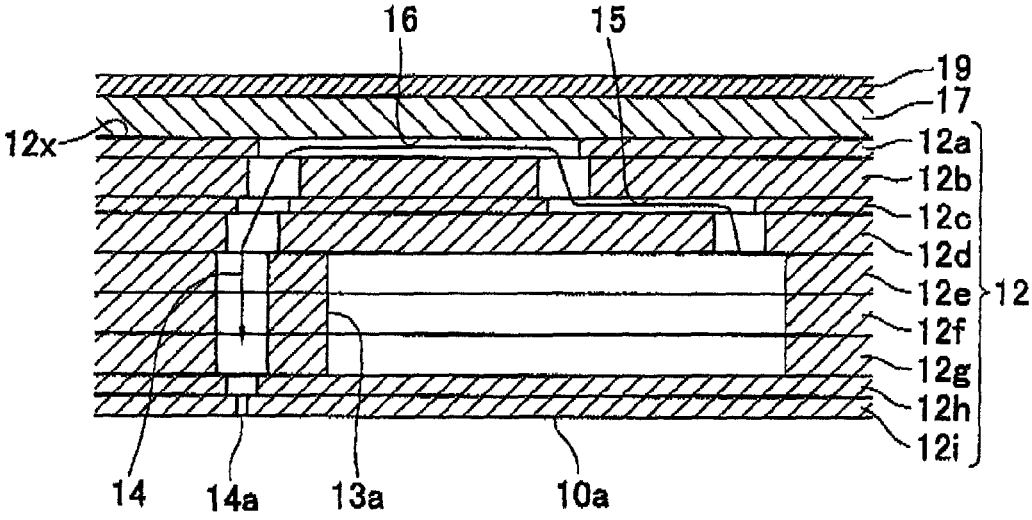
FIG. 4 is a partial cross-sectional view taken along line IV-IV in FIG. 3.

There will be next explained the construction of the head 10 with reference to FIGS. 2-4. It is noted that, in FIG. 3, pressure chambers 16 and apertures 15 are illustrated by solid lines for easier understanding purposes though these elements are located under actuator units 17 and thus should be illustrated by broken lines.

The head 10 includes a reservoir unit 11 (see FIG. 6A), a channel unit 12 (see FIG. 4), the eight actuator units 17 (see FIG. 2) fixed to an upper face 12*x* of the channel unit 12, a Flexible Printed Circuit (FPC) 19 (see FIG. 4) bonded to each of the actuator units 17 and so on which are stacked on one another in a vertical direction. In the reservoir unit 11 are formed ink channels including a reservoir that temporarily stores the ink supplied from the cartridge 39. In the channel unit 12 are formed ink channels each extending from a corresponding one of openings 12*y* of the upper face 12*x* (see FIG. 2) to a corresponding one of the ejection openings 14*a* formed in a lower face of the channel unit 12 (i.e., the ejection face 10*a*). The actuator units 17 include piezoelectric actuators for the respective ejection openings 14*a*.

Protruding portions and recessed portions are formed on and in a lower face of the reservoir unit 11. The protruding portions are bonded to the upper face 12*x* of the channel unit 12 at areas on which no actuator units 17 are disposed (noted that the areas include the openings 12*y* and are enclosed with two-dot chain lines in FIG. 2). A distal end face of each of the protruding portions has an opening connected to the reservoir and facing a corresponding one of the openings 12*y* of the channel unit 12. As a result, the reservoir and individual ink channels 14 are communicated with each other via the above-described openings. The recessed portions face the upper face 12*x* of the channel unit 12, faces of the respective actuator units 17, and a face of the FPC 19 with slight spaces formed therebetween.

The channel unit 12 is a stacked body constituted by nine metal rectangular plates 12*a*-12*i* (see FIG. 4) having generally the same size and bonded to one another. As shown in FIGS. 2-4, the channel unit 12 includes: manifold channels 13 each having a corresponding one of the openings 12*y* as one end; sub-manifold channels 13*a* each branched from a corresponding one of the manifold channels 13; and the individual ink channels 14 respectively extending from outlets of the sub-manifold channels 13*a* to the ejection openings 14*a* via the pressure chambers 16. As shown in FIG. 4, the individual channel 14 is formed for each ejection opening 14*a* so as to have the aperture 15 functioning as a restrictor for adjusting a channel resistance. Generally rhombic openings for respectively exposing the pressure chambers 16 are formed in matrix in areas on the upper face 12*x* to which the actuator units 17 are respectively bonded. The ejection openings 14*a* are formed in matrix in the same pattern as the pressure chambers 16, in the lower face (i.e., the ejection face 10*a*) at areas opposed to the areas on the upper face 12*x* to which the actuator units 17 are respectively bonded.

As shown in FIG. 2, the actuator units 17 each having a trapezoid shape are arranged on the upper face 12*x* in two arrays in a staggered configuration. As shown in FIG. 3, each of the actuator units 17 covers the multiplicity of the pressure chambers 16 formed under the actuator unit 17. Though not shown, each of the actuator units 17 includes: a plurality of piezoelectric layers expanding over the multiplicity of the pressure chambers 16; and electrodes interposing the piezoelectric layers in a thickness direction of the actuator units 17. The electrodes include: a common electrode common for the pressure chambers 16 and individual electrodes provided for the respective pressure chambers 16. The individual electrodes are formed on a face of an uppermost one of the piezoelectric layers.

The FPC 19 has wirings corresponding to the respective electrodes of the actuator units 17, and a driver IC, not shown, is mounted on the wirings. The FPC 19 is fixed at one end thereof to the actuator units 17 and at the other end to a control board, not shown, of the head 10, which is disposed on an upper side of the reservoir unit 11. Under the control of the controller 100, the FPC 19 sends the driver IC various drive signals outputted from the control board and sends the actuator units 17 signals produced by the driver IC.

Figure 5:
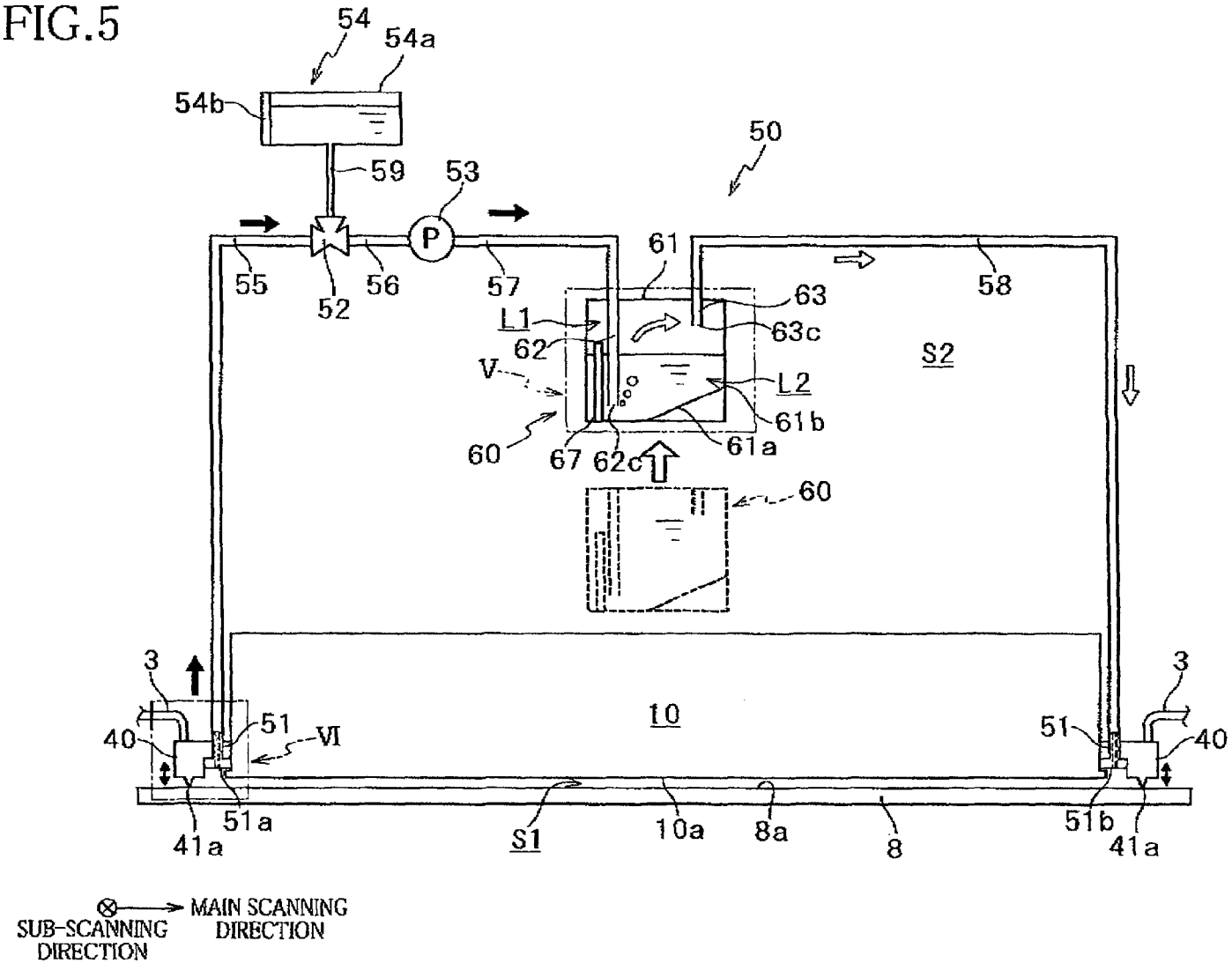
FIG. 5 is a schematic view showing a head holder, an air circulation mechanism, and a humidification-liquid tank of the printer in FIG. 1.

There will be next explained the support-cap unit 6 with reference to FIGS. 1 and 5.

The support-cap unit 6 is disposed so as to face the ejection face 10*a* of the head 10 in the vertical direction. The support-cap unit 6 includes: a rotor 9 having a shaft extending in the main scanning direction and rotatable about the shaft by the control of the controller 100; and a platen 7 and a facing member 8 fixed to an outer circumferential face of the rotor 9. Each of the platen 7 and the facing member 8 is one size larger than the ejection face 10*a* in the main scanning direction and the sub-scanning direction, and the platen 7 and the facing member 8 are disposed so as to be opposed to each other in the vertical direction.

A face of the platen 7 is a support face 7*a* for supporting the sheet P while facing the ejection face 10*a*. A material and a processing for the support face 7*a* are employed so as to reliably hold the sheet P. For example, a silicon layer having a low viscosity is formed on the support face 7*a*, and a multiplicity of ribs are formed on the support face 7*a* in the sub-scanning direction, preventing floating and the like of the sheet P placed on the support face 7*a*. The platen 7 is formed of a resin material.

The facing member 8 is formed of a material such as a glass or a metal (e.g., SUS) having a property of not or hardly sucking water. A face of the facing member 8 is a smooth facing face 8*a* that can face the ejection face 10*a*.

The rotor 9 is controlled by the controller 100 to be rotated such that one of the support face 7*a* and the facing face 8*a* faces the ejection face 10*a*. For example, in the image recording, the support face 7*a* faces the ejection face 10*a* (see FIG. 1). When it is determined in this state that the humidifying maintenance which will be described below is to be performed, the rotor 9 is temporarily moved downward such that the platen 7 and the facing member 8 do not interfere with or do not contact the ejection face 10*a*, then the rotor 9 is rotated 180 degrees such that the facing member 8 faces the ejection face 10*a*, and finally the rotor 9 is moved upward (see FIG. 5).

There will be next explained a construction of the head holder 3 with reference to FIGS. 2, 5, and 6. The head holder 3 is a frame made of a metal, for example, and the cap 40 and a pair of joints 51 provided for the head 10 are mounted on the head holder 3. Recessed portions 3*x* are formed in a face of the head holder 3. The pair of joints 51 are disposed in the respective recessed portions 3*x*.

As shown in FIG. 5, the pair of the joints 51 respectively constitute one and the other ends of a circulation channel of the air circulation mechanism 50 and are respectively disposed near one and the other ends of the head 10 in the main scanning direction. In the humidifying maintenance, an air is sucked or collected through an opening (air inlet opening) 51*a* formed in a lower face of one of the pair of the joints 51 (the left joint 51 in FIG. 5), and a humid air is supplied through an opening (air outlet opening) 51*b* formed in a lower face of the other of the pair of the joints 51 (the right joint 51 in FIG. 5).

Figure 6A:
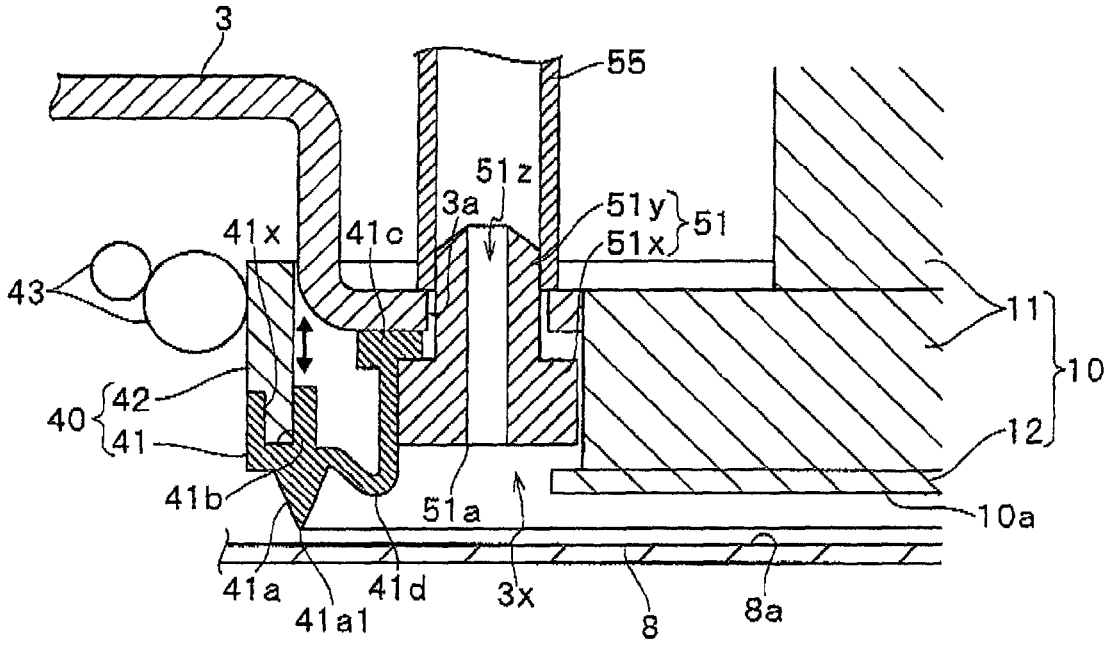

As shown in FIG. 6A, each of the joints 51 has a generally cylindrical shape and has a basal end portion 51*x* and a distal end portion 51*y* extending from the basal end portion 51*x*. A hollow space 51*z* having a circular and cylindrical shape is formed through the basal end portion 51*x* and the distal end portion 51*y* in the vertical direction. The basal end portion 51*x* and the distal end portion 51*y* have different outside diameters from each other, specifically, the basal end portion 51*x* has a greater outside diameter than that of the distal end portion 51*y*. The hollow space 51*z* has a uniform diameter along the vertical direction. A diameter of an upper end portion of the distal end portion 51*y* decreases from a lower side to an upper side thereof, that is, the upper end portion of the distal end portion 51*y* is tapered. This facilitates a connection of one end of a tube 55 or 58 to the distal end portion 51*y*.

The joints 51 are fixed to the head holder 3 in a state in which the distal end portions 51*y* are inserted and fitted in respective through holes 3*a* of the head holder 3. The through holes 3*a* are formed at respective positions at which the joints 51 are disposed on the head holder 3, that is, the through holes 3*a* are respectively formed near one and the other ends of the head 10 in the main scanning direction. The outside diameter of each distal end portion 51*y* is one size smaller than that of the corresponding through hole 3*a*. Thus, a small space is formed between an outer circumferential face of the distal end portion 51*y* and a wall face defining the through hole 3*a* of the head holder 3. This space is sealed by, e.g., a sealing material when the joint 51 is fixed to the head holder 3.

The cap 40 has an annular shape in plan view for enclosing an outer peripheral area of the ejection face 10*a* of the head 10. The cap 40 includes: an elastic member 41 supported by the head holder 3 via a fixed portion 41*c*; and a movable member 42 movable upward and downward.

The elastic member 41 is formed of an elastic material such as a rubber and includes (a) a base portion 41*x*, (b) a projecting portion 41*a* projecting downward from a lower face of the base portion 41*x* so as to have an inverted triangle shape in cross section, (c) the fixed portion 41*c* having a T-shape in cross section and fixed to the head holder 3, and (e) a connecting portion 41*d* for connecting the base portion 41*x* and the fixed portion 41*c* to each other. The elastic member 41 has a circular shape in plan view for enclosing the outer peripheral area of the ejection face 10*a*. An upper end portion of the fixed portion 41*c* is fixed to the head holder 3 by adhesive, for example. The fixed portion 41*c* is sandwiched near the through hole 3*a* between the head holder 3 and the basal end portion 51*x* of the joint 51. The connecting portion 41*d* extends from a lower end of the fixed portion 41*c* and curves to an outside in a direction away from the ejection face 10*a* in plan view, so as to be connected to a lower end of the base portion 41*x*. The connecting portion 41*d* is deformable so as to be deformed according to the upward and downward movement of the movable member 42. An upper face of the base portion 41*x* has a recessed portion 41*b* that is fitted on a lower end of the movable member 42.

The movable member 42 is formed of a rigid material and has a circular shape in plan view for enclosing the outer peripheral area of the ejection face 10*a* like the elastic member 41. The movable member 42 is supported by the head holder 3 via the elastic member 41 so as to be movable relative to the head holder 3 in the vertical direction. Specifically, the movable member 42 is connected to a plurality of gears 43 and moved upward and downward by the gears 43 rotated by a drive power outputted from an up-down motor 44 (see FIG. 8) under the control of the controller 100. In this upward and downward movement of the movable member 42, the base portion 41*x* is also moved upward and downward with the movable member 42 because the lower end of the movable member 42 is fitted in the recessed portion 41*b* of the elastic member 41. When the movable member 42 is moved upward and downward, the projecting portion 41*a* is also moved upward and downward in the state in which the fixed portion 41*c* is fixed to the head holder 3. As a result, a position of a distal end 41*a*1 of the projecting portion 41*a* relative to the ejection face 10*a* in the vertical direction is changed.

In accordance with the upward and downward movement of the movable member 42, the projecting portion 41*a* is selectively positioned at a contact position (see FIG. 5) at which the distal end 41*a*1 is held in contact with the facing face 8*a* of the facing member 8 (which is disposed so as to face the ejection face 10*a* by the support-cap unit 6) and at a distant position (see FIG. 6A) at which the distal end 41*a*1 is distant from the facing face 8*a*. As shown in FIG. 5, when the projecting portion 41*a* is positioned at the contact position, a capping state (sealing state) is established in which the ejection space S1 formed between the ejection face 10*a* and the facing face 8*a* is isolated from or does not communicate with an outside space S2. As shown in FIG. 6A, when the projecting portion 41*a* is positioned at the distant position, an uncapping state (unsealing state) is established in which the ejection space S1 communicates with the outside space S2.

The projecting portion 41*a* is distant from the ejection face 10*a* over an entire perimeter of the ejection face 10*a* (i.e., the lower face of the head 10 in FIG. 2) in plan view. Further, the projecting portion 41*a* has a generally rectangular shape in plan view so as to enclose the ejection face 10*a*.

Figure 6B:
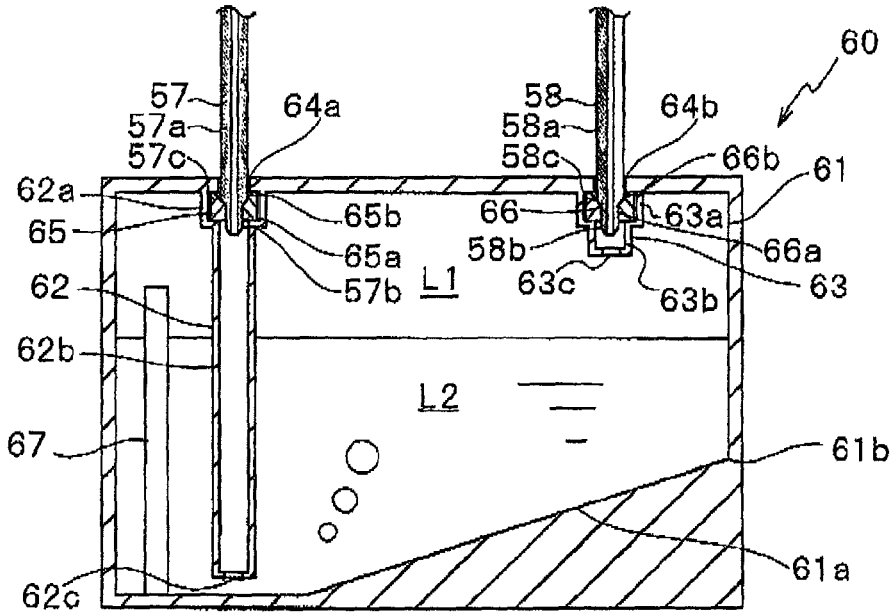

There will be next explained the construction of the humidification-liquid tank 60 with reference to FIGS. 5 and 6B. The humidification-liquid tank 60 is mountable on and removable from the air circulation mechanism 50 and includes a casing 61, two channel pipes 62, 63 having different lengths from each other, the fitted members 65, 66, and a sensor 67 (as one example of a remaining-amount detector).

Figure 7A:
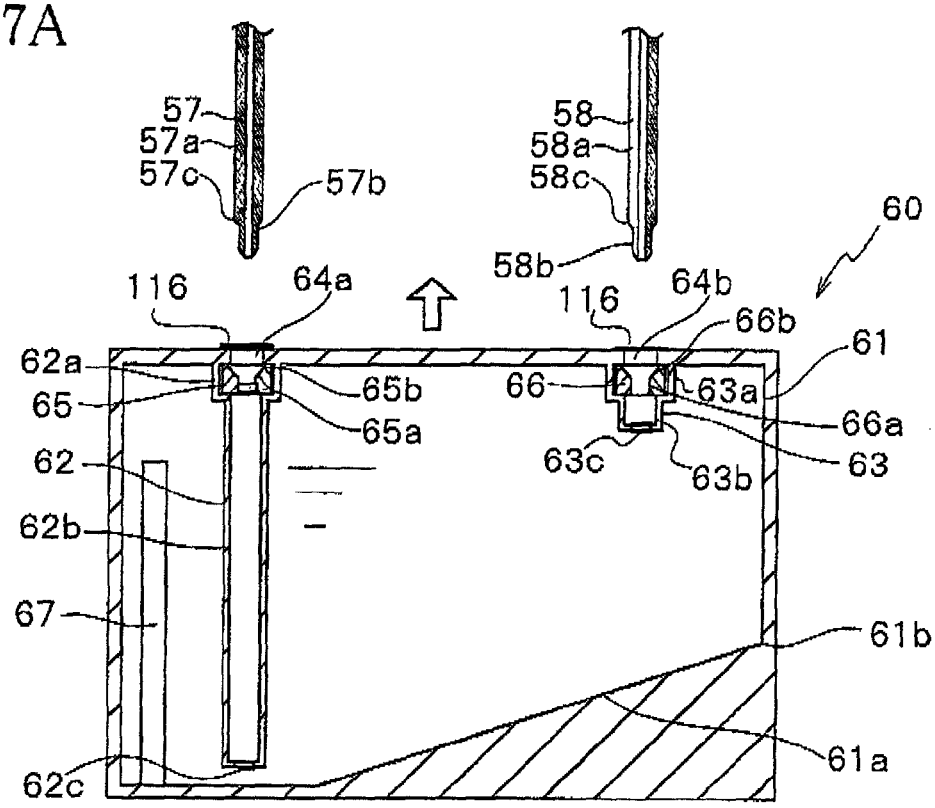
Figure 7B:
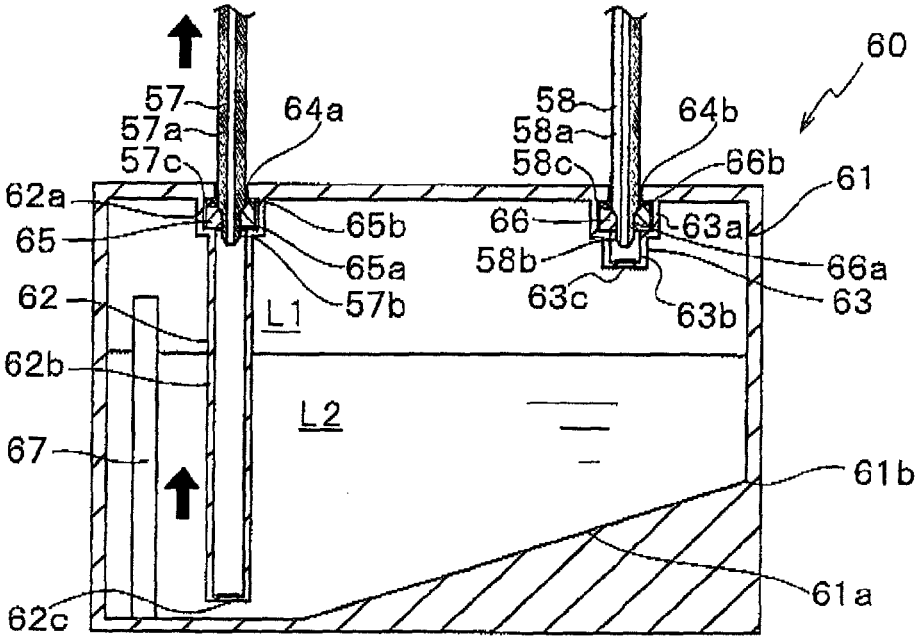

The casing 61 is a tank main body storing the humidification liquid therein. As shown in FIG. 7A, the casing 61 is full of the humidification liquid before the humidification-liquid tank 60 is mounted on the air circulation mechanism 50. As shown in FIG. 7B, when the humidification-liquid tank 60 is mounted on the air circulation mechanism 50, a predetermined amount of the humidification liquid stored in the casing 61 is transferred to a reserve tank 54 which will be described below by the air circulation mechanism 50, resulting in that a liquid layer L2 constituted by the humidification liquid and an air layer L1 having equal to or larger than a predetermined volume are formed in the casing 61. Here, the predetermined volume is a volume which does not cause the humidification liquid stored in the humidification-liquid tank 60 to flow into the ejection space S1 when an air flows by the air circulation mechanism 50 in the humidifying maintenance, and this predetermined volume is a minimum volume of the air layer L1 (hereinafter may be referred as "humidifiable minimum volume"). That is, where the air layer L1 having equal to or larger than the humidifiable minimum volume is formed in the humidification-liquid tank 60, the humidification liquid stored in the humidification-liquid tank 60 never flows into the ejection space S1 in the humidifying maintenance. It is noted that, the air layer L1 is an area in which the air exists in the humidification-liquid tank 60, and the liquid layer L2 is an area in which the humidification liquid exists in the humidification-liquid tank 60. A volume occupied by the air layer L1 in the humidification-liquid tank 60 is a volume of the air in the humidification-liquid tank 60. Likewise, a volume occupied by the liquid layer L2 in the humidification-liquid tank 60 is a volume of the humidification liquid in the humidification-liquid tank 60.

An upper wall of the casing 61 has two insertion holes 64*a*, 64*b* formed therein into which tubes 57, 58 which will be described below are respectively to be inserted. Further, an inner wall of the casing 61 has a tapered inner face 61*a* having such a construction that a cross-sectional area in the humidification-liquid tank 60 (in the casing 61) decreases toward a lower side thereof. That is, the tapered inner face 61*a* is formed on the inner wall of the casing 61 such that a cross-sectional area of an inner space of the casing 61 in a plane parallel to the horizontal plane and defined by the inner wall of the casing 61 including the inner face 61*a* decreases toward a lower side of the inner face 61*a*.

The sensor 67 is a remaining-amount sensor for detecting a remaining amount of the humidification liquid stored in the humidification-liquid tank 60. When the remaining amount of the humidification liquid (water) detected by the sensor 67 has become equal to or less than a prescribed amount (prescribed remaining amount), the controller 100 executes a control to supply the humidification liquid from the reserve tank 54 which will be described below or to display on the display 90 a screen for prompting the user to replace the humidification-liquid tank 60. Here, the prescribed amount is set to be larger than an amount of the humidification liquid when a humidification performance decreases by an increase in a concentration of a nonvolatile component of the humidification liquid.

The channel pipe 62 is a pipe having a cylindrical shape and hanging down from the upper wall of the casing 61. The channel pipe 62 includes a large cylindrical portion 62*a* and a small cylindrical portion 62*b*. The large cylindrical portion 62*a* is located above the small cylindrical portion 62*b*, and an inside diameter of the large cylindrical portion 62*a* is larger than that of the small cylindrical portion 62*b*. The fitted member 65 is accommodated or fitted in the large cylindrical portion 62*a*. This fitted member 65 is a cylindrical member formed of an elastic material such as a synthetic rubber. An outside diameter of the fitted member 65 is larger than each of a diameter of the insertion hole 64*a* and the inside diameter of the small cylindrical portion 62*b*. A through hole 65*a* is formed in a central part of a lower portion of the fitted member 65, and a tapered face 65*b* is formed on an upper portion of the fitted member 65 so as to be continuous to the through hole 65*a*.

A diameter of the through hole 65*a* is slightly smaller than an outside diameter of a small diameter portion 57*b* of the tube 57 which will be described below. As a result, when the small diameter portion 57*b* of the tube 57 is inserted into the through hole 65*a*, an outer face of the small diameter portion 57*b* is brought into contact with an inner face of the fitted member 65, so that the fitted member 65 is elastically deformed such that the through hole 65*a* is spread or widened. An elastic resilience of this fitted member 65 causes the fitted member 65 to be airtightly fitted in the small diameter portion 57*b*. It is noted that the insertion hole 64*a*, the large cylindrical portion 62*a*, the small cylindrical portion 62*b*, and the through hole 65*a* are coaxial with one another.

A lower end of the small cylindrical portion 62*b* of the channel pipe 62 is located below an interface between the liquid layer L2 and the air layer L1. That is, an opening (upstream opening 62*c*) of the lower end of the small cylindrical portion 62*b* of the channel pipe 62 is formed in the liquid layer L2 so as to face the liquid layer L2. In the humidifying maintenance, the air in the ejection space S1 is supplied via this upstream opening 62*c* by a humidification pump 53 (which will be described below) of the air circulation mechanism 50. It is noted that this upstream opening 62*c* is formed below an upper end portion 61*b* of the inner face 61*a*. Further, an amount of the humidification liquid stored below the upper end portion 61*b* of the inner face 61*a* in the casing 61 is set to be larger than the above-described prescribed amount.

The channel pipe 63 has generally the same construction as the channel pipe 62 except the length of the small cylindrical portion in the vertical direction. The channel pipe 63 includes a large cylindrical portion 63*a* in which the fitted member 66 is accommodated or fitted, and a small cylindrical portion 63*b*. The fitted member 66 has generally the same construction as the fitted member 65. A through hole 66*a* is formed in a central part of a lower portion of the fitted member 66, and a tapered face 66*b* is formed on an upper portion of the fitted member 66 so as to be continuous to the through hole 66*a*. A diameter of the through hole 66*a* is slightly smaller than an outside diameter of a small diameter portion 58*b* of the tube 58 which will be described below. Thus, an elastic resilience of the fitted member 66 causes the fitted member 66 to be airtightly fitted in the small diameter portion 58*b*. It is noted that the insertion hole 64*b*, the large cylindrical portion 63*a*, the small cylindrical portion 63*b*, and the through hole 66*a* are coaxial with one another.

A lower end of the small cylindrical portion 63*b* of the channel pipe 63 is located above the interface between the liquid layer L2 and the air layer L1. That is, an opening (downstream opening 63*c*) of the lower end of the small cylindrical portion 63*b* of the channel pipe 63 is formed in the air layer L1 so as to face the air layer L1. In the humidifying maintenance, the air humidified in the casing 61 is discharged into the ejection space S1 via the downstream opening 63*c* by the air circulation mechanism 50.

A distance between an axis (center) of the channel pipe 62 and an axis (center) of the channel pipe 63 is set to be the same as a distance between an axis (center) of the small diameter portion 57*b* of the tube 57 which will be described below and an axis (center) of the small diameter portion 58*b* of the tube 58 which will be described below.

There will be next explained the air circulation mechanism 50 with reference to FIGS. 5, 6A, and 6B. The air circulation mechanism 50 includes the pair of joints 51, the tubes 55-59, the humidification pump 53 configured to transfer the humidification liquid in forward and reverse directions, the reserve tank 54, and a three-way valve 52.

The reserve tank 54 includes (i) a tank main body 54*a* that temporarily stores the humidification liquid therein, and (ii) a sensor 54*b* (as one example of a storage-amount detector) for detecting a remaining amount (storage amount) of the humidification liquid stored in the tank main body 54*a*. A volume of the reserve tank 54 is set so as to be the same as the above-described humidifiable minimum volume (predetermined volume) of the air layer L1 in the humidification-liquid tank 60.

One end of the tube 55 is connected to the distal end portion 51*y* of the left joint 51 (in FIG. 5) provided on the head 10, and the other end of the tube 55 is connected to the three-way valve 52. That is, the tube 55 connects between the hollow space 51*z* of the one joint 51 and the three-way valve 52 such that the hollow space 51*z* and the three-way valve 52 can communicate with each other. The tube 56 connects between the three-way valve 52 and the humidification pump 53 such that the three-way valve 52 and the humidification pump 53 can communicate with each other. One end portion of the tube 57 is fitted on the fitted member 65 of the humidification-liquid tank 60 so as to be mounted on and removable from the fitted member 65, and the other end portion of the tube 57 is connected to the humidification pump 53. The one end portion of the tube 57 which can be fitted on the fitted member 65 is formed so as to face downward. This one end portion includes a large diameter portion 57*a*, the small diameter portion 57*b*, and a tapered portion 57*c* which are formed integrally with one another. The small diameter portion 57*b* is located nearer to a distal (lower) end of the tube 57, and an outside diameter of the diameter portion 57*b* is smaller than that of the large diameter portion 57*a*. The tapered portion 57*c* continuously connects between the large diameter portion 57*a* and the small diameter portion 57*b*. When the humidification-liquid tank 60 is mounted on the air circulation mechanism 50, the tapered portion 57*c* is held in close contact with the tapered face 65*b* of the fitted member 65.

One end portion of the tube 58 is fitted on the fitted member 66 of the humidification-liquid tank 60, the other end portion of the tube 58 is connected to the distal end portion 51*y* of the right joint 51 (in FIG. 5) provided on the head 10. Like the tube 57, the one end portion of the tube 58 which can be fitted on the fitted member 66 is formed so as to face downward. This one end portion includes a large diameter portion 58*a*, the small diameter portion 58*b*, and a tapered portion 58*c* which are formed integrally with one another. The small diameter portion 58*b* is located nearer to a distal (lower) end of the tube 58, and an outside diameter of the small diameter portion 58*b* is smaller than that of the large diameter portion 58*a*. The tapered portion 58*c* continuously connects between the large diameter portion 58*a* and the small diameter portion 58*b*. When the humidification-liquid tank 60 is mounted on the air circulation mechanism 50, the tapered portion 58*c* is held in close contact with the tapered face 66*b* of the fitted member 66.

One end of the tube 59 is connected to the three-way valve 52, the other end thereof is connected to the reserve tank 54. The three-way valve 52 permits the connection of the tube 55 or the tube 59 to the tube 56 such that only the permitted tube 55 or 59 can communicate with the tube 56. Specifically, in the humidifying maintenance in which the air is circulated between the ejection space S1 and the humidification-liquid tank 60, the three-way valve 52 permits the communication between the tube 55 and the tube 56. In transferring the humidification liquid between the humidification-liquid tank 60 and the reserve tank 54, the three-way valve 52 permits the communication between the tube 59 and the tube 56.

In the humidifying maintenance, the humidification pump 53 is driven to be rotated forwardly in the capping state in the state in which the tube 55 and the tube 56 are communicated with each other by the three-way valve 52, so that the air in the ejection space S1 is collected through the opening 51*a*. The air collected through the opening 51*a* passes through the hollow space 51*z* of the joint 51, the tube 55, the three-way valve 52, and the tube 56 to reach the humidification pump 53, and the air then reaches the humidification-liquid tank 60 by passing through the tube 57. The air is supplied to the liquid layer L2 in the humidification-liquid tank 60 through the upstream opening 62*c*. The supplied air is humidified by the humidification liquid in the humidification-liquid tank 60, whereby the air becomes the humid air. This humid air passes through the air layer L1 in the humidification-liquid tank 60, the downstream opening 63*c*, and the tube 58 and flows into the ejection space S1 through the opening 51*b*. In view of the above, the tubes 55, 56, 57, 58 function as the circulation channel for circulating the humid air.

The humidification pump 53 adjusts the amount of the humidification liquid (the volume of the air layer L1) in the humidification-liquid tank 60 by transferring the humidification liquid between the humidification-liquid tank 60 and the reserve tank 54. Specifically, when the humidification-liquid tank 60 is mounted on the air circulation mechanism 50, the humidification pump 53 is driven to be rotated reversely in the state in which the tube 59 and the tube 56 are communicated with each other by the three-way valve 52, whereby the humidification liquid in the casing 61 of the humidification-liquid tank 60 is transferred into the reserve tank 54 until the reserve tank 54 having the humidifiable minimum volume becomes full of the humidification liquid. As a result, the air layer L1 in the humidification-liquid tank 60 becomes the humidifiable minimum volume.

Where the amount of the humidification liquid stored in the humidification-liquid tank 60 which has been detected by the sensor 67 is equal to or less than the prescribed amount and where the amount (storage amount) of the humidification liquid stored in the reserve tank 54 which has been detected by the sensor 54*b* is not zero (that is, the reserve tank 54 is not empty), the humidification pump 53 is rotated forwardly in the state in which the tube 59 and the tube 56 are communicated with each other by the three-way valve 52, so that the humidification liquid in the reserve tank 54 is transferred into the humidification-liquid tank 60. As a result, the humidification liquid is not stored in the reserve tank 54 in the mounting and removal of the humidification-liquid tank 60. In the present embodiment, the air circulation mechanism 50 is one example of a humid-air supply mechanism. Further, the humidification pump 53 is one example of an adjusting portion and a supply portion.

There will be next explain an operation the humidification-liquid tank 60 in the mounting and removal thereof. As shown in FIG. 7A, the humidification-liquid tank 60 (the casing 61) is full of the humidification liquid before the humidification-liquid tank 60 is mounted on the air circulation mechanism 50. At this time, the insertion holes 64*a*, 64*b* formed in the upper wall of the casing 61 are sealed by sealing tapes 116, respectively.

When the humidification-liquid tank 60 is mounted on the air circulation mechanism 50, the user removes or peels off the sealing tapes 116 so as to expose the insertion holes 64*a*, 64*b* to an outside of the humidification-liquid tank 60. Then, the small diameter portion 57*b* of the tube 57 is inserted from the insertion hole 64*a* into the humidification-liquid tank 60, and the small diameter portion 58*b* of the tube 58 is inserted from the insertion hole 64*b* into the humidification-liquid tank 60. Specifically, the humidification-liquid tank 60 to be mounted is moved relative to the tubes 57, 58 in an upward and downward direction (vertical direction), whereby the small diameter portions 57*b*, 58*b* are inserted into the humidification-liquid tank 60. Here, since the diameter of each of the through holes 65*a*, 66*a* of the respective fitted members 65, 66 is slightly smaller than the outside diameter of the corresponding one of the small diameter portions 57*b*, 58*b* of the respective tubes 57, 58 as described above, the elastic resiliences of the fitted members 65, 66 respectively cause the fitted members 65, 66 to be airtightly fitted in the small diameter portions 57*b*, 58*b*. As a result, each of the tubes 57, 58 and the humidification-liquid tank 60 communicate with each other in the state in which each of the fitted members 65, 66 is airtightly fitted in the corresponding one of the small diameter portions 57*b*, 58*b*. Then, as shown in FIG. 7B, the humidification pump 53 is rotated reversely in the state in which the tube 59 and the tube 56 are communicated with each other by the three-way valve 52, so that the humidification liquid in the humidification-liquid tank 60 is transferred into the reserve tank 54 until the air layer L1 of the humidifiable minimum volume is formed in the humidification-liquid tank 60.

When the humidification-liquid tank 60 is removed from the air circulation mechanism 50, the humidification-liquid tank 60 is moved relative to the tubes 57, 58 in the upward and downward direction so as to be moved away from the tubes 57, 58, so that the small diameter portion 57*b* of the tube 57 is removed from the humidification-liquid tank 60 through the insertion hole 64*a*, and the small diameter portion 58*b* of the tube 58 is removed from the humidification-liquid tank 60 through the insertion hole 64*b*. In view of the above, the humidification-liquid tank 60 can be mounted on and removed from the air circulation mechanism 50 by the movement of the humidification-liquid tank 60 relative to the tubes 57, 58 in the upward and downward direction.

It is noted that the humidification liquid stored in the humidification-liquid tank 60 contains water and a preserving agent for preventing water decomposition (decay). Since this preserving agent contains nonvolatile components, the concentration of the nonvolatile components in the humidification-liquid tank 60 increases due to evaporation of the water. As a result, the humidification performance decreases, making it impossible to efficiently produce the air humidified in the humidification-liquid tank 60. In order to solve this problem, in the present embodiment, when the remaining amount of the humidification liquid in the humidification-liquid tank 60 has become equal to or less than the prescribed amount, the humidification liquid temporarily stored in the reserve tank 54 is supplied to the humidification-liquid tank 60, or the screen for prompting the user to replace the humidification-liquid tank 60 is displayed on the display 90. Further, since the humidification-liquid tank 60 is mountable on and removable from the air circulation mechanism 50 as described above, even where the concentration of the nonvolatile components in the humidification-liquid tank 60 has increased, it is possible to maintain the humidification performance of the printer 1 by replacing the humidification-liquid tank 60 with new one.

Figure 8:
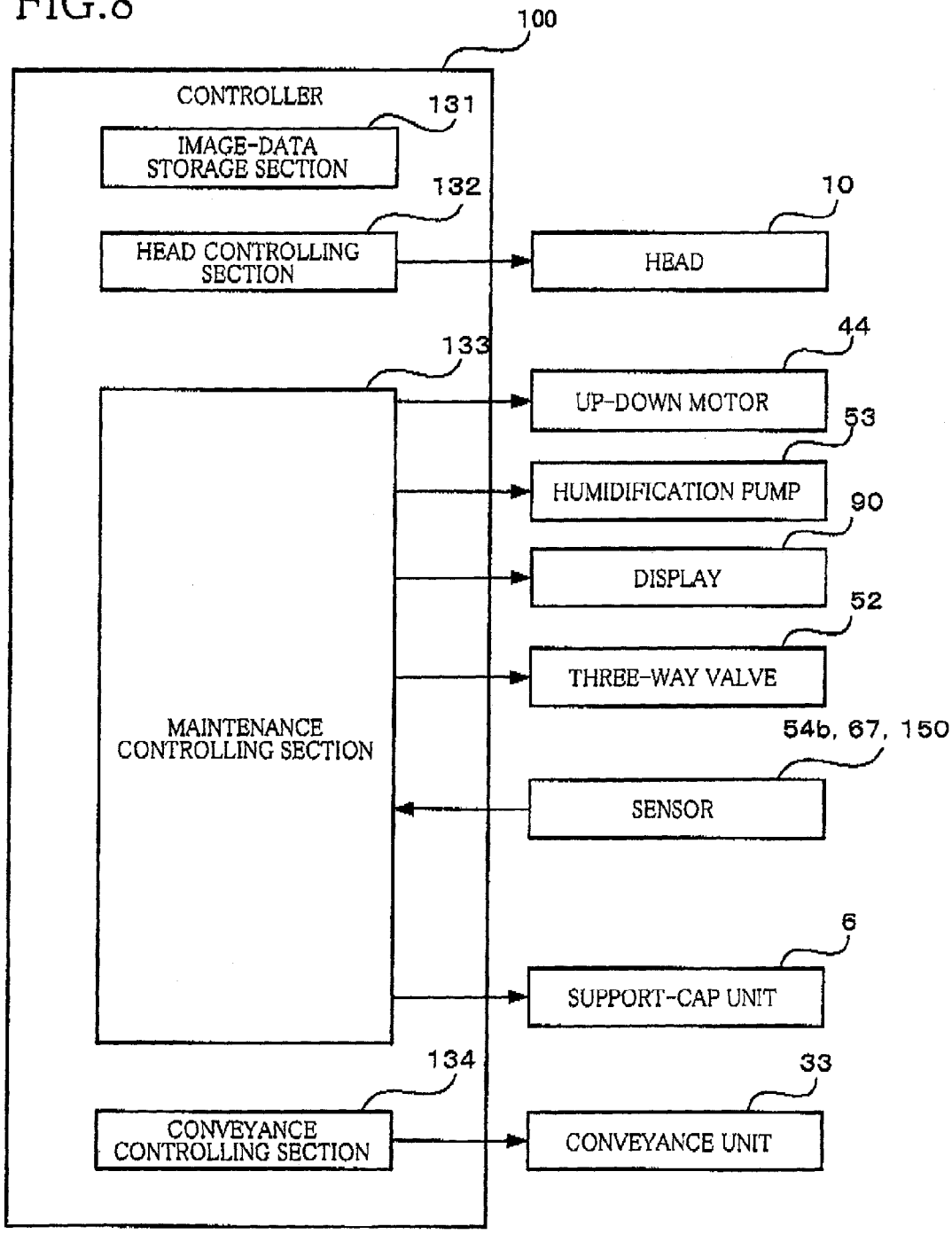
FIG. 8 is a block diagram showing functions of a controller of the printer in FIG. 1.

There will be next explained the controller 100. The controller 100 includes a Central Processing Unit (CPU); a nonvolatile memory for rewritably storing programs executed by the CPU and data used for these programs; and a Random Access Memory (RAM) for temporarily storing the data upon the execution of the program. The controller 100 includes various functional sections which are constituted by cooperation of these hardwares and softwares in the nonvolatile memory with each other. As shown in FIG. 8, the controller 100 includes an image-data storage section 131, a head controlling section 132, a maintenance controlling section 133, and a conveyance controlling section 134.

The image-data storage section 131 stores the image data based on which an image is recorded on the sheet P. The conveyance controlling section 134 is configured to control the conveyance unit 33 such that the sheet P is conveyed through the sheet conveyance path at a predetermined speed. The head controlling section 132 is configured to control the head 10 such that the image is recorded on the sheet P conveyed by the conveyance unit 33 on the basis of the image data stored in the image-data storage section 131, and such that the flushing is performed in the maintenance operation.

The maintenance controlling section 133 is configured to control the support-cap unit 6, the humidification pump 53 and the three-way valve 52 of the air circulation mechanism 50, and the up-down motor 44 for raising or lowering the movable member 42 (the distal end 41*a*1 of the projecting portion 41*a*) in order to perform the humidifying maintenance.

The humidifying maintenance is an operation in which the humid air is supplied into the ejection space S1 in the capping state, and the humidifying maintenance is started when a predetermined length of time has passed from the last recording.

When the humidifying maintenance is started, the maintenance controlling section 133 controls the support-cap unit 6 such that the facing face 8*a* of the facing member 8 faces the ejection face 10*a*. The maintenance controlling section 133 then rotates the gears 43 to move the movable member 42 downward. In the recording, the projecting portion 41*a* is located at the distant position (see FIG. 6A), but this downward movement of the movable member 42 moves the projecting portion 41*a* to the contact position (see FIG. 5). As a result, the ejection space S1 is sealed to establish the capping state. It is noted that the maintenance controlling section 133 moves the projecting portion 41*a* to the contact position to establish the capping state in a standby state or a nonoperating state other than the recording.

The maintenance controlling section 133 then controls the three-way valve 52 such that the tube 56 and the tube 55 are communicated with each other and then drives the humidification pump 53 to rotate forwardly, so that the air in the ejection space S1 is collected through the opening 51*a* of the one joint 51. In this operation, the air collected through the opening 51*a* passes through the hollow space 51*z* of the joint 51, the tube 55, the three-way valve 52, and the tube 56 to reach the humidification pump 53, and the air then reaches the channel pipe 62 of the humidification-liquid tank 60 by passing through the tube 57. The air is supplied to the liquid layer L2 in the humidification-liquid tank 60 (i.e., beneath a water surface) through the upstream opening 62*c* of the channel pipe 62. The humid air humidified by the humidification liquid in the humidification-liquid tank 60 is discharged from the air layer L1 in the humidification-liquid tank 60 through the downstream opening 63*c* of the channel pipe 63 in the humidification-liquid tank 60. In this operation, the humid air discharged from the air layer L1 in the humidification-liquid tank 60 has a humidity near 100%. This humid air is supplied from the opening 51*b* of the other joint 51 into the ejection space S1 through the tube 58. In FIG. 5, black arrows represent a flow of the air before the humidification, and white arrows represent a flow of the air after the humidification.

When the humid air has been thus supplied into the ejection space S1 through the opening 51*b*, a humidity in the ejection space S1 increases, which decreases a density of the ink having a relatively high viscosity in the ejection openings 14*a*. As thus described, the humidity of the humid air may be any value as long as the humidity is equal to or higher than an environmental humidity when the humid air is in equilibrium. Specifically, when the humid air is in equilibrium, the humidity is preferably equal to or higher than an appropriate humidity in which the viscosity of the ink in the ejection openings 14*a* becomes a viscosity that allows appropriate ink ejection. As a result, the humidifying maintenance is completed.

In addition to the above-described humidifying maintenance, the maintenance controlling section 133 transfers the humidification liquid between the humidification-liquid tank 60 and the reserve tank 54. Specifically, when the remaining amount of the humidification liquid in the humidification-liquid tank 60 which has been detected by the sensor 67 has become equal to or less than the prescribed amount, the sensor 54*b* detects the remaining amount of the humidification liquid stored in the reserve tank 54. Where the humidification liquid is stored in the reserve tank 54, the maintenance controlling section 133 controls the three-way valve 52 such that the tube 59 and the tube 56 are communicated with each other and drives the humidification pump 53 to rotate forwardly such that the humidification liquid in the reserve tank 54 is transferred into the humidification-liquid tank 60. It is noted that the transfer of the humidification liquid from the reserve tank 54 to the humidification-liquid tank 60 is performed until the remaining amount of the humidification liquid in the humidification-liquid tank 60 becomes larger than the prescribed amount. On the other hand, where no humidification liquid is stored in the reserve tank 54, the maintenance controlling section 133 controls the display 90 to display thereon the screen for prompting the user to replace the humidification-liquid tank 60.

At a time when a sensor 150 (see FIG. 8) has detected the mounting of the humidification-liquid tank 60 on the air circulation mechanism 50, the maintenance controlling section 133 controls the three-way valve 52 such that the tube 59 and the tube 56 are communicated with each other and drives the humidification pump 53 to rotate reversely such that the humidification liquid in the humidification-liquid tank 60 is transferred to the reserve tank 54. It is noted that the humidification liquid is transferred from the humidification-liquid tank 60 to the reserve tank 54 until the reserve tank 54 becomes full.

When having received the recording command, the maintenance controlling section 133 rotates the gears 43 to move the movable member 42 upward so as to move the projecting portion 41*a* from the contact position to the distant position. The maintenance controlling section 133 then controls the support-cap unit 6 to rotate such that the platen 7 faces the ejection face 10*a*. As a result, the printer 1 becomes the recordable state. It is noted that, when the printer 1 becomes the standby state or the nonoperating state after the recording is completed, the maintenance controlling section 133 controls the support-cap unit 6 to rotate such that the facing face 8*a* of the facing member 8 faces the ejection face 10*a* and moves the movable member 42 downward so as to move the projecting portion 41*a* from the distant position to the contact position to establish the capping state.

As described above, in the printer 1 as the present embodiment, when the concentration of the nonvolatile components of the stored humidification liquid has increased, the humidification-liquid tank 60 can be replaced with new one, making it possible to prevent the decrease in the humidification performance of the printer 1.

Further, in this printer 1, the air is supplied to the upstream opening 62*c* formed so as to face the liquid layer L2 in the humidification-liquid tank 60 to produce the humid air. Thus, it is possible to efficiently produce the humid air with this simple construction to supply the humid air into the ejection space S1.

Further, in this printer 1, the humidification-liquid tank 60 has the inner face 61*a* tapered such that the cross-sectional area in the humidification-liquid tank 60 decreases toward the lower side of the humidification-liquid tank 60, and the upstream opening 62*c* is formed at the position lower than the upper end portion 61*b* of the inner face 61*a*. Thus, it is possible to reduce the remaining amount of the humidification liquid in the replacement of the humidification-liquid tank 60.

Further, in this printer 1, at a time when the humidification-liquid tank 60 is mounted on the air circulation mechanism 50, the humidification liquid in the humidification-liquid tank 60 is transferred to the reserve tank 54 by the humidification pump 53 such that the volume of the air layer L1 becomes equal to or larger than the humidifiable minimum volume. Thus, it is possible to prevent the humidification liquid from flowing into the ejection space S1 in the humidifying maintenance.

Further, in this printer 1, the humidification liquid stored in the reserve tank 54 is supplied to the humidification-liquid tank 60 when the remaining amount of the humidification liquid in the humidification-liquid tank 60 has decreased. Thus, the humidification liquid discharged to the outside of the humidification-liquid tank 60 in the mounting of the humidification-liquid tank 60 is also used for the production of the humid air, making it possible to lengthen a length of time to reach the replacement of the humidification-liquid tank 60.

Further, in this printer 1, the volume of the reserve tank 54 is the same as the humidifiable minimum volume of the air layer L1 in the humidification-liquid tank 60. Thus, it is easy to adjust an amount of the humidification liquid discharged from the humidification-liquid tank 60 to the reserve tank 54 in the mounting of the humidification-liquid tank 60.

Second Embodiment

Figure 9:
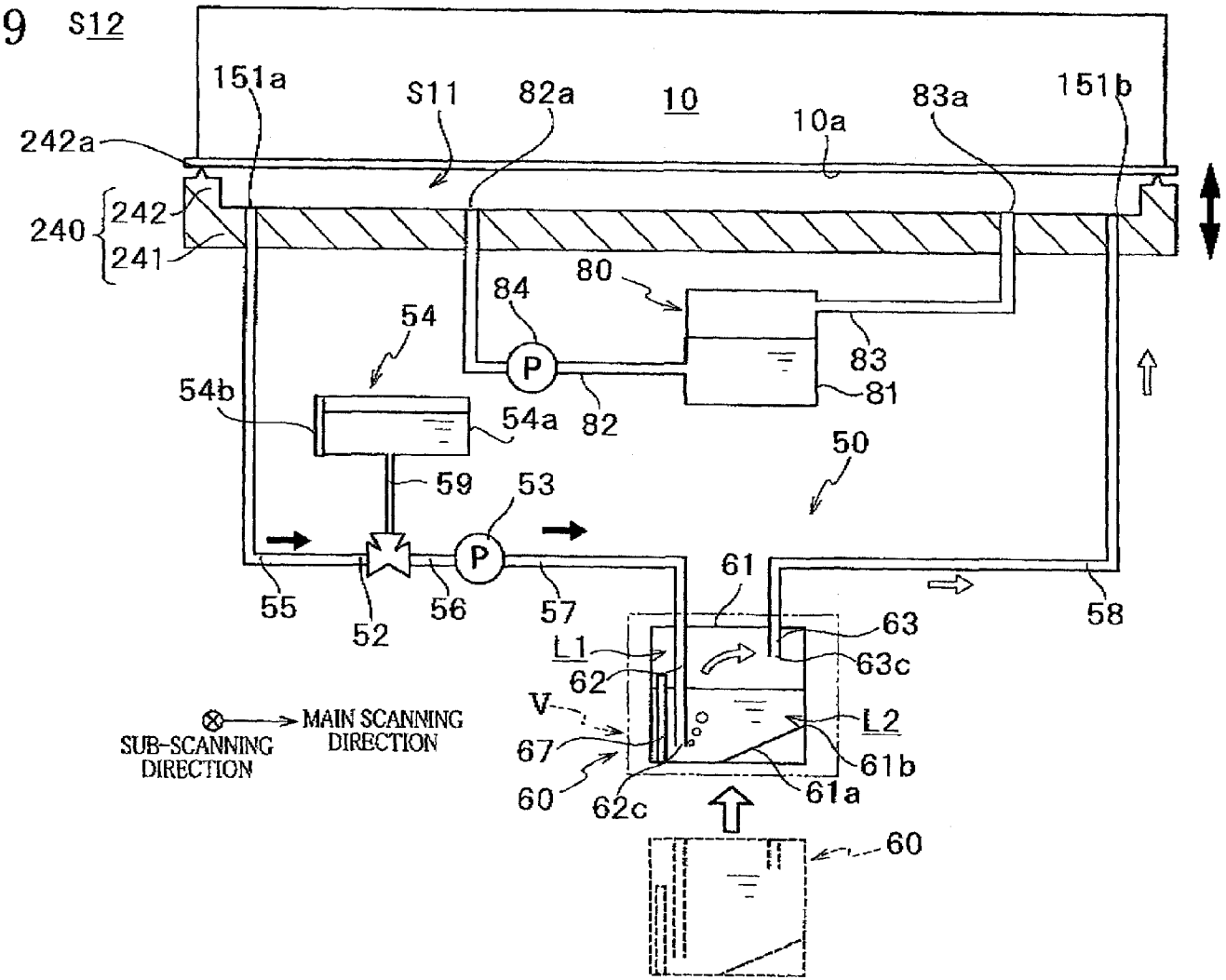
FIG. 9 is a schematic view showing a cap and a humidifying mechanism in a second embodiment of the present invention.

There will be next explained a second embodiment of the present invention. As shown in FIG. 9, the second embodiment is different from the first embodiment in that a cap 240 is provided independently of the head 10, that a cleaning maintenance is performed for cleaning an area of the cap 240 which faces an ejection space S11, and that a collecting mechanism 80 is provided. It is noted that the same reference numerals as used in the first embodiment are used to designate the corresponding elements of the second embodiment, and an explanation of which is dispensed with.

The cap 240 is a recessed member constituted by an opposed member 241 and an annular member 242 formed integrally with each other. The opposed member 241 is opposed to or faces the ejection face 10*a*, and the annular member 242 is supported by an outer circumferential edge of the opposed member 241. At least one of the head 10 and the cap 240 is moved upward or downward to be selectively positioned at a contact position at which an upper end portion 242*a* of the annular member 242 is held in contact with the ejection face 10*a* and a distant position at which the upper end portion 242*a* is distant from the ejection face 10*a*. When the cap 240 is located at the contact position, the ejection space S11 is capped by the cap 240 so as to be sealed or isolated from an outside space S12 (that is, a capping state is established). When the cap 240 is located at the distant position, the ejection space S11 is exposed to the outside space S12 (that is, an uncapping state is established). It is noted that this printer 1 may be configured such that, in times other than the humidifying maintenance and the cleaning maintenance, the cap 240 waits or is located at a waiting position (not facing the ejection face 10*a*), and in the humidifying maintenance or the cleaning maintenance, the cap 240 is moved from the waiting position to the position facing the ejection face 10*a*.

An air inlet opening 151*a* and an air outlet opening 151*b* are formed in the opposed member 241 so as to function as parts of the circulation channel of the air circulation mechanism 50. In the humidifying maintenance, the humidification pump 53 is rotated forwardly, so that the air having flowed from the ejection space S11 through the air inlet opening 151*a* is supplied to the humidification-liquid tank 60 via the upstream opening 62*c*. The air humidified in the humidification-liquid tank 60 is then discharged into the ejection space S11 via the downstream opening 63*c* and the air outlet opening 151*b*.

A humidification-liquid outlet opening 82*a* and a communication opening 83*a* are formed in the opposed member 241 so as to function parts of a collection channel of the collecting mechanism 80. The collecting mechanism 80 includes a waste-liquid tank 81, a tube 82, a tube 83, and a collection pump 84. The tube 82 is connected to the waste-liquid tank 81 and the humidification-liquid outlet opening 82*a* so as to communicate the waste-liquid tank 81 and the ejection space S11 with each other. The tube 83 is connected to the waste-liquid tank 81 and the communication opening 83*a* so as to also communicate the waste-liquid tank 81 and the ejection space S11 with each other. The collection pump 84 is provided on the tube 82.

The cleaning maintenance is a maintenance for cleaning the area of the cap 240 which faces the ejection space S11 in the capping state by using some of the humidification liquid stored in the humidification-liquid tank 60. In the present embodiment, when the humidification-liquid tank 60 is mounted on the air circulation mechanism 50, the maintenance controlling section 133 controls the three-way valve 52 such that the tube 55 and the tube 56 are communicated with each other and drives the humidification pump 53 to be rotated reversely such that the humidification liquid in the humidification-liquid tank 60 is transferred into the ejection space S11 until the volume of the air layer L1 in the humidification-liquid tank 60 becomes the humidifiable minimum volume. As a result, the humidification liquid in the humidification-liquid tank 60 is supplied into the ejection space S11 via the air inlet opening 151*a*, and the area of the cap 240 which faces the ejection space S11 is cleaned with the supplied humidification liquid. The collection pump 84 is then driven, so that the humidification liquid (waste liquid) supplied into the ejection space S11 is discharged into the waste-liquid tank 81 via the humidification-liquid outlet opening 82*a*. Then, the air in the waste-liquid tank 81 is discharged into the ejection space S11 through the tube 83 and the communication opening 83*a*. As a result, the waste liquid stored in the ejection space S11 can be collected smoothly. The collecting mechanism 80 is one example of a discharging portion.

As described above, in the printer 1 as the present embodiment, when the humidification-liquid tank is mounted, the humidification liquid discharged to the outside of the humidification-liquid tank 60 can be used for cleaning the area of the cap 240 which faces the ejection space S11. Thus, it is possible to effectively utilize the humidification liquid.

Further, the circulation path for circulating the humid air is formed in the humidifying maintenance. Thus, a consumption amount of the water can be reduced, making it possible to lengthen the length of time to reach the replacement of the humidification-liquid tank 60. Further, since the humidification liquid in the humidification-liquid tank 60 is discharged into the ejection space S11 by the humidification pump 53 used for the humidifying maintenance, the construction of the printer 1 can be simplified.

It is noted that, when the humidification-liquid tank 60 is mounted on the air circulation mechanism 50, the humidification liquid discharged from the humidification-liquid tank 60 may be supplied into the ejection space S11 as the cleaning maintenance and stored into the reserve tank 54. In this case, a sum of the volume of the reserve tank 54 and the volume of the humidification liquid used for the cleaning maintenance is preferably set so as to be the same as the humidifiable minimum volume of the air layer L1 in the humidification-liquid tank 60. Further, the cleaning maintenance may be performed at a timing other than the mounting of the humidification-liquid tank 60.

First Modification

Figure 10A:
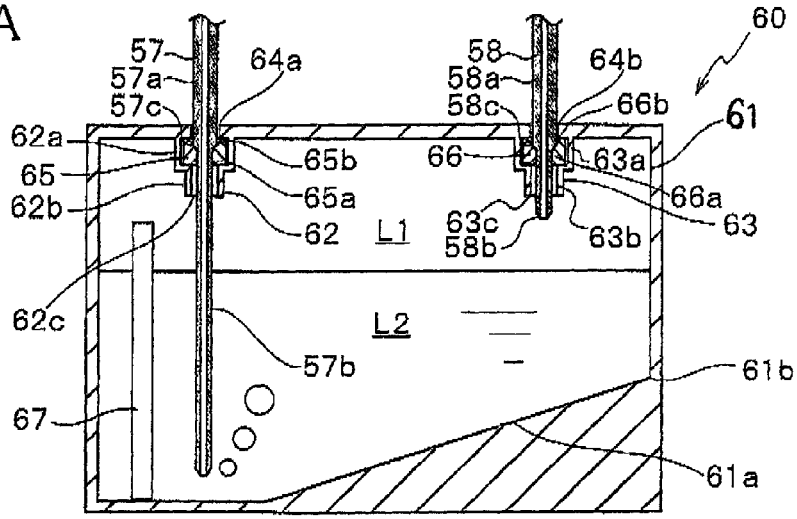

In the above-described embodiment, the lower end of the small cylindrical portion 62*b* of the channel pipe 62 is located below the interface between the liquid layer L2 and the air layer L1, and the channel pipe 62 partly constitutes the circulation channel, but the present invention is not limited to this construction. For example, as shown in FIG. 10A, the lower end of the small cylindrical portion 62*b* may be located above the interface, and the channel pipe 62 may not constitute the circulation channel. In this case, lengths of the respective small diameter portions 57*b*, 58*b* are set such that, when the humidification-liquid tank 60 is mounted on the air circulation mechanism 50, a lower end of the small diameter portion 57*b* of the tube 57 is located below the interface between the liquid layer L2 and the air layer L1, and a lower end of the small diameter portion 58*b* of the tube 58 is located above the interface between the liquid layer L2 and the air layer L1. As a result, in the humidifying maintenance, the air is supplied into the liquid layer L2 through an opening of the lower end of the small diameter portion 57*b* of the tube 57. The humid air humidified in the humidification-liquid tank 60 is supplied into the ejection space S1 through an opening of the lower end of the small diameter portion 58*b* of the tube 58.

Second Modification

In the above-described embodiment, the channel pipes 62, 63 are provided on the upper wall of the casing 61 but may be provided on a side wall or a lower wall of the casing 61. There will be explained a case where the channel pipes 62, 63 are provided on the same side wall of the casing 61, with reference to FIGS. 10B and 10C.

The channel pipe 63 is provided above the channel pipe 62 such that the downstream opening 63*c* is located in the air layer L1 so as to face the air layer L1. Valve mechanisms 70 are respectively accommodated in the channel pipes 62, 63. One end of the tube 57 which is to be fitted in the fitted member 65 is formed so as to face in the horizontal direction, and one end of the tube 58 which is to be fitted in the fitted member 66 is formed so as to face in the same direction of the one end the tube 57. The humidification-liquid tank 60 is mounted on and removed from the air circulation mechanism 50 by moving the humidification-liquid tank 60 and the air circulation mechanism 50 relative to each other in the horizontal direction.

Each of the valve mechanisms 70 is accommodated in a corresponding one of the small cylindrical portions 62*b*, 63*b* and includes a valve member 68 and a coil spring 69. Each valve member 68 is mounted in the corresponding small cylindrical portion 62*b* or 63*b* so as to be movable in the horizontal direction toward and away from the corresponding fitted member 65 or 66. Each valve member 68 closes or seals the corresponding through hole 65*a* or 66*a* in a state in which the valve member 68 is held in contact with the fitted member 65 or 66. Each coil spring 69 is for urging the corresponding valve member 68 in a direction in which the corresponding valve member 68 closes the corresponding through hole 65*a* or 66*a*. One of the coil springs 69 is disposed between the valve member 68 and an end face of the small cylindrical portion 62*b* near the upstream opening 62*c*, and the other of the coil springs 69 is disposed between the valve member 68 and an end face of the small cylindrical portion 63*b* near the downstream opening 63*c*.

In each of the small cylindrical portions 62*b*, 63*b*, there are formed a plurality of guide portions, not shown, extending in the horizontal direction and projecting to an inside of the small cylindrical portion at respective areas thereof in its circumferential direction. This construction permits the valve members 68 to move reliably in the horizontal direction in the respective small cylindrical portions 62*b*, 63*b*. Spaces between the plurality of guide portions partly constitute the circulation channel communicating with the inside of the casing 61.

Figure 10B:
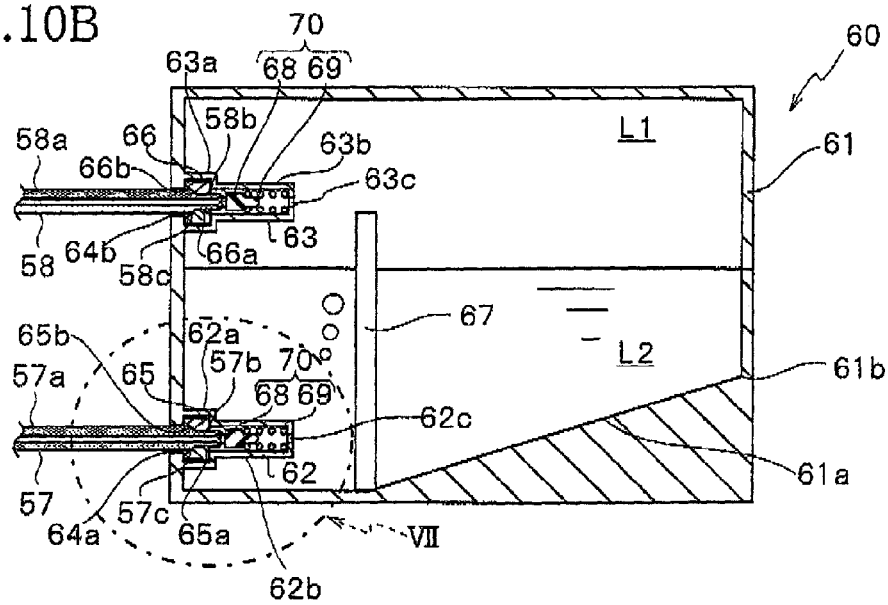
Figure 10C:
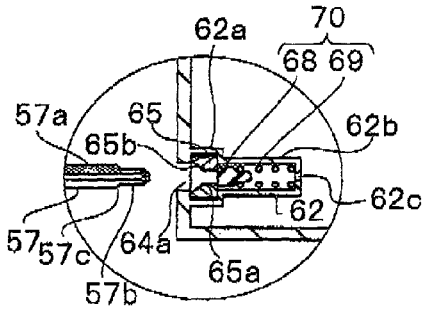
FIG. 10C is a partial cross-sectional view showing an area VII enclosed with a one-dot chain line in FIG. 10B before the mounting of the humidification-liquid tank in the second modification.

There will be next explained opening and closing operations of the valve mechanisms 70 in the mounting and removal of the humidification-liquid tank 60. As shown in FIG. 10C, before the humidification-liquid tank 60 is mounted on the air circulation mechanism 50, urging forces of the coil springs 69 urge the respective valve members 68 in the direction in which the valve members 68 close the respective through holes 65*a*, 66*a* (i.e., a leftward direction in FIG. 10C), so that the valve members 68 are held in contact with the respective fitted members 65, 66. Thus, the through holes 65*a*, 66*a* of the respective fitted members 65, 66 are closed by the respective valve members 68.

When the humidification-liquid tank 60 is mounted on the air circulation mechanism 50, the small diameter portion 57*b* of the tube 57 is inserted into the humidification-liquid tank 60 through the insertion hole 64*a*, and the small diameter portion 58*b* of the tube 58 is inserted into the humidification-liquid tank 60 through the insertion hole 64*b*. The small diameter portions 57*b*, 58*b* are inserted into the humidification-liquid tank 60 by the movement of the humidification-liquid tank 60 relative to the tubes 57, 58. Here, a length of each the small diameter portions 57*b*, 58*b* in its axial direction is set to be longer than a length of the corresponding one of the through holes 65*a*, 66*a* of the respective fitted members 65, 66 in its axial direction. Thus, as shown in FIG. 10B, the small diameter portions 57*b*, 58*b* are respectively inserted through the through holes 65*a*, 66*a* of the respective fitted members 65, 66, and distal ends of the respective small diameter portions 57*b*, 58*b* are brought into contact with the respective valve members 68. Thus, the valve members 68 are pressed by the respective small diameter portions 57*b*, 58*b* against the urging forces of the respective coil springs 69 to be moved in a rightward direction in FIG. 10B, whereby the valve members 68 come off or are released from the respective fitted members 65, 66. As a result, as shown in FIG. 10B, there are formed (i) a channel extending from the opening of the distal end of the small diameter portion 57*b* to the upstream opening 62*c* through the spaces between the guide portions of the small cylindrical portion 62*b* and (ii) a channel extending from the opening of the distal end of the small diameter portion 58*b* to the downstream opening 63*c* through the spaces between the guide portions of the small cylindrical portion 63*b* are formed. As thus described, when the tubes 57, 58 are inserted, the valve members 68 are moved in accordance with the insertions, which opens the channels.

When the humidification-liquid tank 60 is removed from the air circulation mechanism 50, the tubes 57, 58 are removed from the humidification-liquid tank 60. In this operation, as shown in FIG. 10B, the urging forces of the coil springs 69 urge the respective valve members 68 in the direction in which the through holes 65*a*, 66*a* are closed (in a leftward direction in FIG. 10B), whereby the valve members 68 are brought into contact with the respective fitted members 65, 66, so as to close the respective channels. In view of the above, in this modification, since the valve mechanisms 70 are provided on the humidification-liquid tank 60, it is possible to prevent the humidification liquid from flowing to the outside of the humidification-liquid tank 60 when and after the humidification-liquid tank 60 is removed from the air circulation mechanism 50.

While the embodiments of the present invention have been described above, it is to be understood that the invention is not limited to the details of the illustrated embodiments, but may be embodied with various changes and modifications, which may occur to those skilled in the art, without departing from the spirit and scope of the invention. For example, in the above-described embodiments, the circulation passage in which the humid air is circulated in the humidifying maintenance is formed, but the humid air discharged to the ejection space may not be circulated.

Further, in the above-described embodiments, the humid air is produced by supplying the air to the upstream opening 62*c* facing the liquid layer L2 in the humidification-liquid tank 60, but the humid air may be produced by another mechanism. For example, the humid air may be produced by heating the humidification liquid by a heater. In this case, the lower end of the small cylindrical portion 62*b* of the channel pipe 62 may be located in the air layer L1. That is, the upstream opening 62*c* may be formed so as to face the air layer L1.

Further, in the above-described embodiments, the humidification-liquid tank 60 is full of the humidification liquid before the humidification-liquid tank 60 is mounted, but the humidification-liquid tank 60 may not be full as long as the humidification liquid having an amount equal to or greater than the above-described prescribed amount is stored.

It is noted that, in the above-described embodiments, the sensor 67 is attached to the humidification-liquid tank 60, and the sensor 54*b* is attached to the reserve tank 54, but these sensors may not be provided where the remaining amount of the liquid in the tank can be detected or estimated. For example, this printer 1 may be configured such that a driving time of the humidification pump 53 is stored, and the remaining amount of the liquid in the humidification-liquid tank 60 or the reserve tank 54 is estimated on the basis of this driving time to realize the present invention.

Further, in the above-described embodiments, when the storage amount of the liquid in the reserve tank 54 has become zero, the screen for prompting the user to replace the humidification-liquid tank 60 is displayed on the display 90, but this screen may be displayed when the storage amount of the liquid in the reserve tank 54 has not become zero. For example, the screen for prompting the user to replace the humidification-liquid tank 60 may be displayed when the storage amount of the liquid in the reserve tank 54 has become less than a predetermined amount.

Further, in the above-described embodiments, when the remaining amount of the humidification liquid in the humidification-liquid tank 60 has become equal to or less than the prescribed amount, the humidification liquid is transferred from the reserve tank 54 to the humidification-liquid tank 60. Thus, the amount of the humidification liquid stored in the reserve tank 54 can be estimated by detecting the remaining amount of the humidification liquid in the humidification-liquid tank 60 by the sensor 67. That is, it is possible to estimate that the amount of the humidification liquid stored in the reserve tank 54 is zero, where the remaining amount of the humidification liquid which has been detected by the sensor 67 has become less than a prescribed amount, has become a value considerably less than the prescribed amount, or continues to be less than the prescribed amount for some period of time. Thus, when the remaining amount of the humidification liquid in the humidification-liquid tank 60 has become less than the prescribed amount or when the remaining amount of the humidification liquid has become equal to or less than a predetermined amount that is less than the prescribed amount, the screen for prompting the user to replace the humidification-liquid tank 60 may be displayed. Further, when the state in which the remaining amount of the humidification liquid in the humidification-liquid tank 60 is less than the prescribed amount has continued for a period that is equal to or longer than a predetermined period, the screen for prompting the user to replace the humidification-liquid tank 60 may be displayed.

Further, in the above-described embodiments, the humidification liquid is transferred between the humidification-liquid tank 60 and the reserve tank 54 by the humidification pump 53, but the transfer of the humidification liquid may be performed by another mechanism as long as the amount of the humidification liquid stored in the reserve tank 54 can be made zero in the mounting and removal of the humidification-liquid tank 60. For example, this printer 1 may be configured such that a channel for directly communicating the reserve tank 54 and the humidification-liquid tank 60 with each other and such that an upper face of the tank main body 54*a* of the reserve tank 54 is positioned below an upper face of the casing 61 of the humidification-liquid tank 60, and a lower face of the tank main body 54*a* is positioned above a lower face of the casing 61. In this construction, the humidification liquid can be transferred between the humidification-liquid tank 60 and the reserve tank 54 by a water head difference.

Further, the projecting portion 41*a* is not limited to be movable as in the above-described embodiment. For example, the printer 1 may be configured such that the projecting portion is fixed to the head holder so as not to be movable, and the position of the distal end of the projecting portion relative to the ejection face is constant. In this case, the position of the distal end of the projecting portion relative to the ejection face can be changed by raising and lowering the head holder or the support face, whereby the projecting portion can be selectively positioned at the contact position and the distant position.

Further, a shape and a position of each of the air inlet opening and the air outlet opening of the circulation channel are not particularly limited as long as the opening is formed in the head or the head holder so as to be opened in the ejection space. For example, the printer 1 may be configured such that one of the openings is formed in the head, and the other of the openings is formed in the head holder. The opening may be formed in the projecting portion. Further, the printer 1 may be configured such that each recessed portion 3*x* is not formed in the head or the face of the head holder, and the opening(s) of the one end and/or the other end of the circulation channel is formed at the same height level as that of the ejection face 10*a*. The openings may be formed at positions interposing (on opposite sides of) the ejection face 10*a* in the sub-scanning direction in plan view (in the case where the openings are formed in the head, the openings may be formed at positions interposing an ejection-opening group in the sub-scanning direction in plan view). Alternatively, the openings may be formed at positions not interposing the ejection face 10*a* (or the ejection-opening group) in plan view. That is, the openings may be formed on the same side of the ejection face 10*a* (or the ejection-opening group) in one direction.

The present invention is applicable not only to the monochrome printer but also to a color printer. The present invention is applicable to any of a line printer and a serial printer. Further, the application of the present invention is not limited to the printer, and the present invention is also applicable to devices such as a facsimile machine and a copying machine. Further, the present invention is also applicable to a device configured to eject liquid other than the ink. The number of the heads in the liquid ejection apparatus only needs to be equal to or greater than one. The recording medium is not limited to the sheet P and may be various types of recordable media. Further, if the humidification performance decreases by concentration of the nonvolatile components, tap water may be used as the humidification liquid. In this case, components such as a chlorine component as a bactericide are examples of the nonvolatile components.

What is claimed is:

1. A liquid ejection apparatus comprising:

a liquid ejection head having an ejection face that has a plurality of ejection openings formed therein, the liquid ejection head being configured to eject liquid through the plurality of ejection openings to record an image on a recording medium, an ejection space being defined so as to face the ejection face;

a humidification-liquid tank storing humidification liquid that has a nonvolatile component;

a sealing mechanism configured to selectively establish (i) a sealing state in which the sealing mechanism seals the ejection space from an outside and (ii) an unsealing state in which the sealing mechanism does not seal the ejection space from the outside; and a humid-air supply mechanism configured to supply humid air into the ejection space when the sealing mechanism is in the sealing state, the humid air being an air humidified by the humidification liquid in the humidification-liquid tank, wherein the humidification-liquid tank is configured to be mountable on and removable from the humid-air supply mechanism, wherein a liquid layer constituted by the humidification liquid stored in the humidification-liquid tank and an air layer constituted by an air in the humidification-liquid tank are formed in the humidification-liquid tank, wherein the humidification-liquid tank has an upstream opening and a downstream opening that is formed so as to face the air layer, and wherein the humid-air supply mechanism includes a pump configured to discharge the humid air through the downstream opening.

2. The liquid ejection apparatus according to claim 1, wherein the pump of the humid-air supply mechanism is configured to supply an air to the humidification-liquid tank via the upstream opening such that the humid air is discharged through the downstream opening.

3. The liquid ejection apparatus according to claim 2, wherein the upstream opening of the humidification-liquid tank is formed so as to face the liquid layer, and wherein the pump of the humid-air supply mechanism is configured to supply the air to the liquid layer via the upstream opening.

4. The liquid ejection apparatus according to claim 2, wherein the humidification-liquid tank has a tapered inner face having a shape in which a cross-sectional area in the humidification-liquid tank decreases toward a lower side of the humidification-liquid tank in a vertical direction, and wherein the upstream opening is formed below an upper end of the tapered inner face in the vertical direction.

5. The liquid ejection apparatus according to claim 1, further comprising an adjusting portion configured to discharge the humidification liquid in the humidification-liquid tank to an outside of the humidification-liquid tank to adjust a volume of the air layer in the humidification-liquid tank such that the volume of the air layer becomes equal to or greater than a predetermined volume when the humidification-liquid tank is mounted on the humid-air supply mechanism.

6. The liquid ejection apparatus according to claim 5, further comprising:

a reserve tank which temporarily stores the humidification liquid having been discharged to the outside of the humidification-liquid tank by the adjustment of the adjusting portion; and a supply portion configured to supply the humidification liquid stored in the reserve tank, into the humidification-liquid tank when a remaining amount of the humidification liquid in the humidification-liquid tank has decreased.

7. The liquid ejection apparatus according to claim 6, wherein, where the remaining amount of the humidification liquid in the humidification-liquid tank is equal to or less than a prescribed remaining amount, and where a storage amount of the humidification liquid stored in the reserve tank is not zero, the supply portion supplies the humidification liquid stored in the reserve tank, into the humidification-liquid tank.

8. The liquid ejection apparatus according to claim 6, wherein the adjusting portion includes a pump for discharging the humidification liquid from the humidification-liquid tank to the reserve tank, and wherein the supply portion is configured to supply the humidification liquid stored in the reserve tank to the humidification-liquid tank by a transfer of the humidification liquid by the pump of the adjusting portion in a direction opposite to a direction in which the pump discharges the humidification liquid from the humidification-liquid tank to the reserve tank.

9. The liquid ejection apparatus according to claim 6, wherein a volume of the reserve tank is the same as a predetermined volume of the air layer in the humidification-liquid tank.

10. The liquid ejection apparatus according to claim 6, further comprising a display configured to display a screen for prompting a replacement of the humidification-liquid tank.

11. The liquid ejection apparatus according to claim 10, further comprising a storage-amount detector configured to detect a storage amount of the humidification liquid stored in the reserve tank, wherein the display is configured to display the screen on the basis of the storage amount of the humidification liquid which has been detected by the storage-amount detector.

12. The liquid ejection apparatus according to claim 11, wherein the display is configured to display the screen when the storage amount of the humidification liquid which has been detected by the storage-amount detector has become zero.

13. The liquid ejection apparatus according to claim 10, further comprising a remaining-amount detector configured to detect the remaining amount of the humidification liquid in the humidification-liquid tank, wherein the display is configured to display the screen on the basis of the remaining amount of the humidification liquid which has been detected by the remaining-amount detector.

14. The liquid ejection apparatus according to claim 5, wherein the sealing mechanism has a humidification-liquid outlet opening communicating with an outside of the ejection space, wherein the humidification liquid discharged to the outside of the humidification-liquid tank by the adjustment of the adjusting portion is supplied to the ejection space in the sealing state, and wherein the liquid ejection apparatus further comprises a discharging portion configured to discharge the humidification liquid supplied to the ejection space, through the humidification-liquid outlet opening.

15. The liquid ejection apparatus according to claim 14, wherein one of the ejection face and the sealing mechanism has an air inlet opening and an air outlet opening each communicating with the ejection space in the sealing state, wherein the pump of the humid-air supply mechanism is configured to discharge the humid air into the ejection space via the downstream opening and the air outlet opening and to supply the air having flowed from the ejection space via the air inlet opening, to the humidification-liquid tank via the upstream opening when the sealing mechanism is in the sealing state, and wherein the pump is configured to transfer the humidification liquid or the air in a forward or a reverse direction and functions as the adjusting portion configured to adjust the volume of the air layer by supplying the humidification liquid in the humidification-liquid tank to the ejection space via the upstream opening and the air inlet opening after the humidification-liquid tank is mounted on the humid-air supply mechanism.

16. A method for replacing a humidification-liquid tank of a liquid ejection apparatus, the liquid ejection apparatus comprising:

a liquid ejection head having an ejection face that has a plurality of ejection openings formed therein, the liquid ejection head being configured to eject liquid through the plurality of ejection openings to record an image on a recording medium, an ejection space being defined so as to face the ejection face;

the humidification-liquid tank storing humidification liquid that has a nonvolatile component;

a sealing mechanism configured to selectively establish (i) a sealing state in which the sealing mechanism seals the ejection space from an outside and (ii) an unsealing state in which the sealing mechanism does not seal the ejection space from the outside;

a humid-air supply mechanism configured to supply humid air into the ejection space when the sealing mechanism is in the sealing state, the humid air being an air humidified by the humidification liquid in the humidification-liquid tank, the humidification-liquid tank being configured to be mountable on and removable from the humid-air supply mechanism, wherein a liquid layer constituted by the humidification liquid stored in the humidification-liquid tank and an air layer constituted by an air in the humidification-liquid tank are formed in the humidification-liquid tank, wherein the humidification-liquid tank has an upstream opening and a downstream opening that is formed so as to face the air layer, and wherein the humid-air supply mechanism includes a pump configured to discharge the humid air through the downstream opening; and a display configured to display a screen for prompting a replacement of the humidification-liquid tank, the method comprising replacing the humidification-liquid tank after the display has displayed the screen for prompting the replacement of the humidification-liquid tank.

17. A liquid ejection apparatus comprising:

a liquid ejection head having an ejection face that has a plurality of ejection openings formed therein, the liquid ejection head being configured to eject liquid through the plurality of ejection openings to record an image on a recording medium, an ejection space being defined so as to face the ejection face;

a humidification-liquid tank storing humidification liquid that has a nonvolatile component;

a sealing mechanism configured to selectively establish (i) a sealing state in which the sealing mechanism seals the ejection space from an outside and (ii) an unsealing state in which the sealing mechanism does not seal the ejection space from the outside; and a humid-air supply mechanism configured to supply humid air, the humid air being an air humidified by the humidification liquid in the humidification-liquid tank, wherein the humidification-liquid tank is configured to be mountable on and removable from the humid-air supply mechanism, wherein a liquid layer constituted by the humidification liquid stored in the humidification-liquid tank and an air layer constituted by an air in the humidification-liquid tank are formed in the humidification-liquid tank, wherein the humidification-liquid tank has an upstream opening and a downstream opening that is formed so as to face the air layer, and wherein the humid-air supply mechanism includes a pump configured to discharge the humid air through the downstream opening.

* * * * *